US012637744B2

(12) United States Patent
Minami et al.

(10) Patent No.: US 12,637,744 B2
(45) Date of Patent: May 26, 2026

(54) HOT-DIP GALVANIZED STEEL SHEET AND METHOD FOR PRODUCING SAME, AND MEMBER

(71) Applicant: JFE STEEL CORPORATION, Tokyo (JP)

(72) Inventors: Hidekazu Minami, Tokyo (JP); Yusuke Wada, Tokyo (JP); Yuki Toji, Tokyo (JP); Yoichi Makimizu, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 398 days.

(21) Appl. No.: 18/565,655

(22) PCT Filed: Mar. 16, 2022

(86) PCT No.: PCT/JP2022/012094
§ 371 (c)(1),
(2) Date: Nov. 30, 2023

(87) PCT Pub. No.: WO2022/270053
PCT Pub. Date: Dec. 29, 2022

(65) Prior Publication Data

US 2024/0263287 A1 Aug. 8, 2024

(30) Foreign Application Priority Data

Jun. 24, 2021 (JP) ..... 2021-105147

(51) Int. Cl.

| | |
|---|---|
| ***C22C 38/04*** | (2006.01) |
| ***C21D 6/00*** | (2006.01) |
| ***C21D 8/0221*** | (2026.01) |
| ***C21D 8/0247*** | (2026.01) |
| ***C21D 9/46*** | (2006.01) |
| ***C22C 38/02*** | (2006.01) |
| ***C22C 38/06*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.
CPC ..... *C22C 38/04* (2013.01); *C21D 6/005* (2013.01); *C21D 8/0226* (2013.01); *C21D 8/0263* (2013.01); *C21D 8/0268* (2013.01); *C21D 8/0273* (2013.01); *C21D 9/46* (2013.01); *C22C 38/02* (2013.01); *C22C 38/06* (2013.01); *C23C 2/024* (2022.08); *C23C 2/06* (2013.01); *C23C 2/29* (2022.08); *C23C 2/40* (2013.01)

(58) Field of Classification Search
None
See application file for complete search history.

(56) References Cited

U.S. PATENT DOCUMENTS

| | | | | |
|---|---|---|---|---|
| 2014/0162088 | A1 | 6/2014 | Kawata et al. | |
| 2018/0002771 | A1 | 1/2018 | Han et al. | |
| 2020/0377978 | A1 | 12/2020 | Yoshitomi et al. | |
| 2021/0062282 | A1 | 3/2021 | Hasegawa et al. | |
| 2022/0074013 | A1 | 3/2022 | Hasegawa et al. | |
| 2022/0090248 | A1 * | 3/2022 | Yokoyama | C22C 38/58 |
| 2022/0098687 | A1 | 3/2022 | Hasegawa et al. | |
| 2022/0251676 | A1 | 8/2022 | Minami et al. | |

FOREIGN PATENT DOCUMENTS

| | | | | |
|---|---|---|---|---|
| CN | 111433380 | A | 7/2020 | |
| CN | 112840047 | A | 5/2021 | |
| EP | 3822382 | A1 | 5/2021 | |
| JP | 2004308002 | A | 11/2004 | |
| JP | 6777267 | B1 | 10/2020 | |
| JP | 6777274 | B1 * | 10/2020 | C21D 8/00 |
| WO | 2020136988 | A1 | 7/2020 | |
| WO | 2020136989 | A1 | 7/2020 | |
| WO | 2021019947 | A1 | 2/2021 | |

OTHER PUBLICATIONS

Jun. 7, 2022, International Search Report issued in the International Patent Application No. PCT/JP2022/012094.
Dec. 11, 2025, Office Action issued by the China National Intellectual Property Administration in the corresponding Chinese Patent Application No. 202280043941.6 with English language search report.
Jan. 8, 2025, the Extended European Search Report issued by the European Patent Office in the corresponding European Patent Application No. 22827973.3.

* cited by examiner

*Primary Examiner* — Brian D Walck
(74) *Attorney, Agent, or Firm* — KENJA IP LAW PC

(57) ABSTRACT

Provided is a hot-dip galvanized steel sheet that has a high YR, as well as high ductility, stretch flangeability, and bendability, improved shear workability, and a TS of 1,180 MPa or more. The base steel sheet of the hot-dip galvanized steel sheet has a defined chemical composition and steel microstructure. In particular, a number ratio of retained austenite (γ) having an aspect ratio of 2.0 or less is more than 50%, a number of bins of hardness frequency: 0.25 or more is 1, the area ratio of quenched martensite in a surface layer is 80% or less, a surface layer softening thickness is 10 μm or more and 100 μm or less, and the amount of low temperature range diffusible hydrogen is 0.015 mass ppm or less.

16 Claims, No Drawings

HOT-DIP GALVANIZED STEEL SHEET AND METHOD FOR PRODUCING SAME, AND MEMBER

TECHNICAL FIELD

The present disclosure relates to a hot-dip galvanized steel sheet and a method for producing same, and a member.

BACKGROUND

High strength steel sheets for automobiles are being developed to both reduce $CO_2$ emissions by reducing vehicle weight and improve crashworthiness. Further, new laws and regulations are being introduced one after another. Therefore, in order to increase automotive body strength, the application of high strength steel sheets to major structural and reinforcing parts that form the framework of automobile cabins (hereinafter also referred to as automobile frame structural parts) is increasing, in particular high strength steel sheets having a tensile strength (hereinafter also referred to simply as TS) of 1,180 MPa or more.

Further, high strength steel sheets used for automobile frame structural parts are required to have high part strength when formed into automobile frame structural parts. In order to increase part strength, increasing the yield stress in the longitudinal direction of the part (hereinafter also referred to simply as YS) and increasing the yield ratio of the steel sheet (=YS/TS×100, hereinafter also referred to simply as YR) are effective, for example. Accordingly, the impact absorption energy in the event of an automobile collision (hereinafter also referred to simply as impact absorption energy) increases.

Further, automobile frame structural parts, such as crash boxes, for example, have punched end surfaces and bent sections. Therefore, for such parts, use of steel sheets that have high stretch flangeability and bendability, in addition to high ductility, is preferable from the viewpoint of formability.

Further, from the viewpoint of rust resistance of automotive bodies, hot-dip galvanized steel sheets obtained by hot-dip galvanizing are sometimes applied as steel sheets used as material for automobile frame structural parts.

Technology related to such hot-dip galvanized steel sheets, for example, is described in Patent Literature (PTL) 1:

"A high strength hot-dip galvanized steel sheet comprising a base steel sheet and a galvanized layer formed on a surface of the base steel sheet, and having a tensile strength of 780 MPa or more, wherein the base steel sheet has a chemical composition containing, in mass %, C: 0.050% or more and 0.200% or less, Si: 0.10% or more and 0.90% or less, Mn: 2.00% or more and 3.50% or less, P: 0.001% or more and 0.100% or less, S: 0.0200% or less, Al: 1.000% or less, N: 0.0100% or less, Ca: 0.0200% or less, and Cr: 0.300% or less, wherein [% Mn]/[% Si] is 2.9 or more and 11.7 or less, and the balance is Fe and inevitable impurity, wherein, in the steel microstructure:

a total area ratio of one or two types selected from the group consisting of bainite and ferrite is 5% or more and 85% or less;

an area ratio of tempered martensite is 65% or less;

an area ratio of quenched martensite is 5% or more and 40% or less; and an area ratio of retained austenite is 5.0% or less, wherein a ratio of Si enrichment to Mn enrichment in a surface layer of the base steel sheet is 0.7 or more and 1.3 or less, and an amount of diffusible hydrogen in the base steel sheet is 0.80 mass ppm or less.

Note that [% Mn] and [% Si] indicate the content of Mn and Si in the steel by mass %, respectively."

CITATION LIST

Patent Literature

PTL 1: JP 6777267 B1

SUMMARY

Technical Problem

Brittle cracking during shearing is a concern for high strength steel sheets that have a TS of 1,180 MPa or more, particularly for hot-dip galvanized steel sheets. Therefore, good shear workability is also required.

However, according to the hot-dip galvanized steel sheet described in PTL 1, no consideration is given to shear workability. Therefore, from the viewpoint of increasing the applicability to automobile frame structural parts of high strength steel sheets that have a TS of 1,180 MPa or more, and particularly hot-dip galvanized steel sheets, there is a need to develop hot-dip galvanized steel sheets that have high YR, as well as high ductility, stretch flangeability, and bendability, improved shear workability, and a TS of 1,180 MPa or more.

The present disclosure was developed in view of the situation described above, as it would be helpful to provide a hot-dip galvanized steel sheet having a high YR (which results in high part strength when applied to parts), as well as high ductility, stretch flangeability, and bendability, improved shear workability, and a TS of 1,180 MPa or more.

It would also be helpful to provide a method for producing the hot-dip galvanized steel sheet described above.

Further, it would be helpful to provide a member made using the hot-dip galvanized steel sheet described above.

Here, "high YR" (high part strength) means that the YR is 65% or higher.

YR is obtained by the following Formula (2).

$$YR = YS/TS \times 100 \quad \text{(Formula 2)}$$

Further, TS and YS are each measured in accordance with Japanese Industrial Standard JIS Z 2241.

"High ductility" means that a total elongation (hereinafter also referred to simply as E1) measured in accordance with JIS Z 2241 is 6% or more.

"High stretch flangeability" means that a hole expansion ratio (hereinafter also referred to simply as 2) measured in accordance with JIS Z 2256 is 30% or more.

"High bendability" means a 100% pass rate in a bend test conducted in accordance with JIS Z 2248 (for details, see the description with reference to Examples below).

"High shear workability" means that no cracks are observed on a shear end cross section of a test piece in a shear workability test described with reference to the Examples below.

Solution to Problem

The inventors conducted intensive studies to solve the technical problem outlined above. As a result, the inventors made the following discoveries.

(1) For the base steel sheet, a composition was determined and the steel microstructure is made to be mainly martensite (quenched martensite, tempered martensite, and bainite). Accordingly, a TS of 1,180 MPa or more and high stretch flangeability is obtainable.

(2) High ductility is obtainable by securing a certain amount of retained austenite in the steel microstructure of the base steel sheet.

(3) High YR (high part strength) is obtainable by ensuring that the number ratio of crystal grains having an aspect ratio of 2.0 or less is more than 50% among crystal grains constituting retained austenite, and ensuring that a number of bins having a frequency of 0.25 or more in a histogram of hardness distribution at ¼ sheet thickness of the base steel sheet is 1.

(4) High bendability is obtainable by ensuring that the area ratio of quenched martensite in a surface layer of the base steel sheet is 80% or less, and a surface layer softening thickness of the base steel sheet is 10 μm or more to 100 μm or less.

(5) High shear workability is obtainable by ensuring that the amount of low temperature range diffusible hydrogen in the base steel sheet is 0.015 mass ppm or less.

The present disclosure is based on these discoveries and further studies.

Primary features of the present disclosure are as follows.

1. A hot-dip galvanized steel sheet comprising a base steel sheet and a galvanized layer on a surface of the base steel sheet, and having a tensile strength of 1,180 MPa or more, wherein the base steel sheet has a chemical composition containing (consisting of), in mass %, C: 0.090% or more and 0.390% or less, Si: 0.01% or more and 2.50% or less, Mn: 2.00% or more and 4.00% or less, P: 0.100% or less, S: 0.0200% or less, Al: 0.100% or less, and N: 0.0100% or less, with the balance being Fe and inevitable impurity, the steel microstructure comprising, at a ¼ sheet thickness position of the base steel sheet, area ratio of martensite: 70% or more, area ratio of ferrite: 10% or less, and area ratio of retained austenite: 0.5% or more and less than 10.0%, wherein, among crystal grains constituting the retained austenite, the number ratio of crystal grains having an aspect ratio of 2.0 or less is more than 50%, a number of bins having a frequency of 0.25 or more in a histogram of hardness distribution at the ¼ sheet thickness position of the base steel sheet is 1, and in terms of Vickers hardness, a class range of bins in the histogram is from more than $(n-1)\times 20+450$ to $n\times 20+450$ or less, where n is an integer from 1 to 10, in a surface layer of the base steel sheet, the area ratio of quenched martensite is 80% or less, where the surface layer of the base steel sheet is a region from the surface of the base steel sheet to a depth of 10 μm, and surface layer softening thickness of the base steel sheet is 10 μm or more and 100 μm or less, wherein an amount of low temperature range diffusible hydrogen in the base steel sheet is 0.015 mass ppm or less, where the amount of low temperature range diffusible hydrogen in the base steel sheet is the amount of hydrogen released from the base steel sheet when heated from room temperature to 50° C.

2. The hot-dip galvanized steel sheet according to aspect 1, wherein the chemical composition of the base steel sheet further contains, in mass %, at least one selected from the group consisting of O: 0.0100% or less, Ti: 0.200% or less, Nb: 0.200% or less, V: 0.200% or less, Ta: 0.10% or less, W: 0.10% or less, B: 0.0100% or less, Cr: 1.00% or less, Mo: 1.00% or less, Ni: 1.00% or less, Co: 0.010% or less, Cu: 1.00% or less, Sn: 0.200% or less, Sb: 0.200% or less, Ca: 0.0100% or less, Mg: 0.0100% or less, REM: 0.0100% or less, Zr: 0.100% or less, Te: 0.100% or less, Hf: 0.10% or less, and Bi: 0.200% or less.

3. The hot-dip galvanized steel sheet according to aspect 1 or 2, wherein the galvanized layer is a galvannealed layer.

4. A method for producing a hot-dip galvanized steel sheet, the method comprising:

applying a hot rolling process to a steel slab having the chemical composition according to aspect 1 or 2 to obtain a hot-rolled steel sheet, under a set of conditions including:

coiling temperature: 350° C. or more and 600° C. or less, and holding time in a temperature range of 300° C. or more in post-coiling cooling: 5000 s or more;

pickling the hot-rolled steel sheet;

applying a first heat treatment to the hot-rolled steel sheet, under a set of conditions including:

heat treatment temperature: 450° C. or more and 650° C. or less, and holding time in a temperature range of 400° C. or more to the heat treatment temperature or less: 10 min or more;

cold rolling the hot-rolled steel sheet to obtain a cold-rolled steel sheet;

annealing the cold-rolled steel sheet, under a set of conditions including:

average heating rate in a temperature range of 250° C. or more to 700° C. or less: 10° C./s or more, oxygen concentration in a temperature range of 250° C. or more to 700° C. or less: 0.5 vol % or more and 5.0 vol % or less, annealing temperature: 820° C. or more and 950° C. or less, and dew point at annealing temperature range: −35° C. or more;

applying a hot-dip galvanizing treatment to the cold-rolled steel sheet to produce a galvanized steel sheet;

cooling the galvanized steel sheet under a set of conditions including cooling stop temperature: 150° C. or less; and applying a second heat treatment to the galvanized steel sheet under a set of conditions satisfying the following Formula (1):

$$6.5 \leq (T + 273) \times \{\log(t \times 3600) + 20\}/1000 \leq 13.0 \quad \text{(Formula 1)}$$

where T is the heat treatment temperature in the second heat treatment (° C.) and t is the heat holding time in the second heat treatment (h).

5. The method for producing a hot-dip galvanized steel sheet according to aspect 4, wherein, after applying the hot-dip galvanizing treatment, an alloying treatment is applied to the galvanized steel sheet.

6. A member made using the hot-dip galvanized steel sheet according to any one of aspects 1 to 3.

7. The member according to aspect 6, wherein the member is for an automobile frame structural part or for an automobile reinforcing part.

Advantageous Effect

According to the present disclosure, a hot-dip galvanized steel sheet is obtainable that has a high YR, as well as high ductility, stretch flangeability, and bendability, improved shear workability, and a TS of 1,180 MPa or more.

In particular, the hot-dip galvanized steel sheet according to the present disclosure has various superior properties and may be applied to automobile frame structural parts having various sizes and shapes. Accordingly, fuel efficiency may be improved by reducing automotive body weight, and industrial applicability is extremely high.

DETAILED DESCRIPTION

The following describes embodiments of the present disclosure.

[1] Hot-Dip Galvanized Steel Sheet

[1-1] Base Steel Sheet

First, a chemical composition of a base steel sheet of a hot-dip galvanized steel sheet according to an embodiment of the present disclosure is described. Hereinafter, although the unit in all chemical compositions is "mass %", this may be indicated simply as "%", unless otherwise specified.

C: 0.090% or More and 0.390% or Less

C is an important basic component. That is, C is an element that particularly affects the fractions of martensite, ferrite, and retained austenite, as well as the aspect ratio of retained austenite. Here, when the C content is less than 0.090%, the fraction of martensite decreases, making achieving a TS of 1,180 MPa or more difficult. On the other hand, when the C content exceeds 0.390%, the aspect ratio of retained austenite increases, making achieving a desired YR difficult. Therefore, the C content is 0.090% or more and 0.390% or less. The C content is preferably 0.100% or more. The C content is more preferably 0.110% or more. The C content is preferably 0.360% or less. The C content is more preferably 0.350% or less.

Si: 0.01% or More and 2.50% or Less

Si suppresses carbide formation during continuous annealing and promotes formation of retained austenite. In other words, Si is an element that affects the fraction of retained austenite and the aspect ratio of retained austenite. Further, Si is an element that affects the hardness distribution of the base steel sheet, in particular the hardness distribution of martensite. Here, Si content less than 0.01% leads to non-uniform hardness of martensite when cooling after annealing or when applying the second heat treatment. Accordingly, the number of bins having a frequency of 0.25 or more in the histogram of hardness distribution at the ¼ sheet thickness position of the base steel sheet increases, and YR and A decrease. Further, bendability also decreases. On the other hand, when the Si content exceeds 2.50%, the aspect ratio of retained austenite increases, and a desired YR is not achieved. Further, λ also decreases. Therefore, the Si content is 0.01% or more and 2.50% or less. The Si content is preferably 0.10% or more. The Si content is more preferably 0.15% or more. The Si content is preferably 2.00% or less. The Si content is more preferably 1.50% or less.

Mn: 2.00% or More and 4.00% or Less

Mn is an important basic component. That is, Mn is an important element that affects the fraction of martensite in particular. Here, when the Mn content is less than 2.00%, the fraction of martensite decreases, making achieving a TS of 1,180 MPa or more difficult. On the other hand, the Mn content exceeding 4.00% leads to non-uniform hardness of martensite when cooling after annealing or when applying the second heat treatment. Accordingly, the number of bins having a frequency of 0.25 or more in the histogram of hardness distribution at the ¼ sheet thickness position of the base steel sheet increases, and YR and A decrease. Further, bendability also decreases. Therefore, the Mn content is 2.00% or more and 4.00% or less. The Mn content is preferably 2.20% or more. The Mn content is more preferably 2.50% or more. The Mn content is preferably 3.80% or less. The Mn content is more preferably 3.60% or less.

P: 0.100% or Less

P segregates in prior austenite grain boundaries and embrittles the grain boundaries. As a result, ultimate deformability of a steel sheet is reduced, resulting in a decrease in A. Further, bendability also decreases. The P content is therefore 0.100% or less. The P content is preferably 0.070% or less. A lower limit of the P content is not particularly specified, but P is a solid-solution-strengthening-element able to increase steel sheet strength. Therefore, the P content is preferably 0.001% or more.

S: 0.0200% or Less

S exists as a sulfide and reduces the ultimate deformability of steel. Therefore, λ decreases. Further, bendability also decreases. The S content is therefore 0.0200% or less. The S content is preferably 0.0050% or less. Although a lower limit of the S content is not particularly specified, the S content is preferably 0.0001% or more in view of production technology constraints.

Al: 0.100% or Less

Al is an element that raises the A3 transformation temperature and causes creation of a ferrite phase in the steel microstructure. Here, when a large amount of ferrite phase is formed in the steel microstructure, achieving a desired YR becomes difficult. Therefore, the Al content is 0.100% or less. The Al content is preferably 0.050% or less. A lower limit of the Al content is not particularly specified. However, Al suppresses carbide formation during continuous annealing and promotes formation of retained austenite. In other words, Al affects the fraction of retained austenite and the aspect ratio of retained austenite. Therefore, the Al content is preferably 0.001% or more.

N: 0.0100% or Less

N exists as a nitride and reduces the ultimate deformability of steel. Therefore, λ decreases. Further, bendability also decreases. Therefore, the N content is 0.0100% or less. The N content is preferably 0.0050% or less. Although a lower limit of the N content is not particularly specified, the N content is preferably 0.0005% or more in view of production technology constraints.

The base steel sheet of the hot-dip galvanized steel sheet according to an embodiment of the present disclosure has a chemical composition that contains the above elements, with the balance being Fe and inevitable impurity. The base steel sheet of the hot-dip galvanized steel sheet according to an embodiment of the present disclosure has a chemical composition consisting of the above elements, with the balance being Fe and inevitable impurity. Here, examples of inevitable impurity include Zn, Pb, and As. Such impurities are allowed to be included as long as a total amount is 0.100% or less.

The basic chemical composition of the base steel sheet of the hot-dip galvanized steel sheet according to an embodiment of the present disclosure has been described above. Further, at least one of the following optional additive elements may be contained, alone or in combination.

O: 0.0100% or less,
Ti: 0.200% or less,
Nb: 0.200% or less,
V: 0.200% or less,
Ta: 0.10% or less,
W: 0.10% or less,
B: 0.0100% or less,
Cr: 1.00% or less,
Mo: 1.00% or less,
Ni: 1.00% or less,
Co: 0.010% or less,
Cu: 1.00% or less,
Sn: 0.200% or less,
Sb: 0.200% or less,
Ca: 0.0100% or less,
Mg: 0.0100% or less,
REM: 0.0100% or less,
Zr: 0.100% or less,
Te: 0.100% or less,
Hf: 0.10% or less, and
Bi: 0.200% or less.

The following is an explanation of the preferred content of each optional additive element when included.

O: 0.0100% or Less

O exists as an oxide and reduces the ultimate deformability of steel. Therefore, λ decreases. Further, bendability also decreases. The O content is therefore 0.0100% or less. The O content is preferably 0.0050% or less. Although a lower limit of the O content is not particularly specified, the O content is preferably 0.0001% or more in view of production technology constraints.

Ti: 0.200% or Less, Nb: 0.200% or Less, V: 0.200% or Less

Ti, Nb, and V cause precipitates and inclusions to form. When such precipitates and inclusions are coarsened and formed in large amounts, ultimate deformability of the steel sheet is reduced. Therefore, λ decreases. Further, bendability also decreases. Therefore, the content of each of Ti, Nb, and Vis respectively 0.200% or less. The content of each of Ti, Nb, and V is respectively preferably 0.100% or less. A lower limit of the content of each of Ti, Nb, and V is not particularly specified. However, the addition of any of Ti, Nb, and V increases recrystallization temperature during a temperature increase during continuous annealing. Accordingly, a more uniform martensite hardness is achieved, which contributes to an increase in YR. Therefore, the content of each of Ti, Nb, and V is respectively preferably 0.001% or more.

Ta: 0.10% or Less, W: 0.10% or Less

Ta and W cause precipitates and inclusions to form. When such precipitates and inclusions are coarsened and formed in large amounts, ultimate deformability of the steel sheet is reduced. Therefore, λ decreases. Further, bendability also decreases. Therefore, the content of each of Ta and W is respectively 0.10% or less. The content of each of Ta and W is respectively preferably 0.08% or less. A lower limit of the content of each of Ta and Wis not particularly specified. However, Ta and W increase the strength of steel sheets by forming fine carbides, nitrides or carbonitrides during hot rolling or continuous annealing. Therefore, the content of each of Ta and W is respectively preferably 0.01% or more.

B: 0.0100% or Less

B contributes to cracking inside the steel sheet during casting or hot rolling and reduces the ultimate deformability of the steel sheet. Therefore, A decreases. Further, bendability also decreases. The B content is therefore 0.0100% or less. The B content is preferably 0.0080% or less. A lower limit of the B content is not particularly specified. However, B is an element that segregates at an austenite grain boundary during annealing and improves hardenability. Therefore, the B content is preferably 0.0003% or more.

Cr: 1.00% or Less, Mo: 1.00% or Less, Ni: 1.00% or Less

Excessive Cr, Mo, and Ni content causes an increase in coarse precipitates and inclusions and a reduction in the ultimate deformability of the steel sheet. Therefore, λ decreases. Further, bendability also decreases. Therefore, the content of each of Cr, Mo, and Ni is respectively 1.00% or less. The content of each of Cr, Mo, and Ni is respectively preferably 0.80% or less. A lower limit of the content of each of Cr, Mo, and Ni is not particularly specified. However, Cr, Mo, and Ni are all elements that improve hardenability. Therefore, the content of each of Cr, Mo, and Ni is respectively preferably 0.01% or more.

Co: 0.010% or Less

Excessive Co content causes an increase in coarse precipitates and inclusions and a reduction in the ultimate deformability of the steel sheet. Therefore, λ decreases. Further, bendability also decreases. Therefore, the Co content is 0.010% or less. The Co content is preferably 0.008% or less. A lower limit of the Co content is not particularly specified. However, Co is an element that improves hardenability. Therefore, the Co content is preferably 0.001% or more.

Cu: 1.00% or Less

Excessive Cu content causes an increase in coarse precipitates and inclusions and a reduction in the ultimate deformability of the steel sheet. Therefore, λ decreases. Further, bendability also decreases. Therefore, the Cu content is 1.00% or less. The Cu content is preferably 0.80% or less. A lower limit of the Cu content is not particularly specified. However, Cu is an element that improves hardenability. Therefore, the Cu content is preferably 0.01% or more.

Sn: 0.200% or Less

Sn contributes to cracking inside the steel sheet during casting or hot rolling and reduces the ultimate deformability of the steel sheet. Therefore, A decreases. Further, bendability also decreases. Therefore, the Sn content is 0.200% or less. The Sn content is preferably 0.100% or less. A lower limit of the Sn content is not particularly specified. However, Sn is an element that improves hardenability. Therefore, the Sn content is preferably 0.001% or more.

Sb: 0.200% or Less

Excessive Sb content causes an increase in coarse precipitates and inclusions and a reduction in the ultimate deformability of the steel sheet. Therefore, λ decreases. Further, bendability also decreases. Therefore, the Sb content is 0.200% or less. The Sb content is preferably 0.100% or less. A lower limit of the Sb content is not particularly specified. However, Sb is an element that controls surface layer softening thickness and allows strength adjustment. Therefore, the Sb content is preferably 0.001% or more.

Ca: 0.0100% or Less, Mg: 0.0100% or Less, REM: 0.0100% or Less

Excessive Ca, Mg, and REM content causes an increase in coarse precipitates and inclusions and a reduction in the ultimate deformability of the steel sheet. Therefore, λ decreases. Further, bendability also decreases. Therefore, the content of each of Ca, Mg, and REM is respectively 0.0100% or less. The content of each of Ca, Mg, and REM is respectively preferably 0.0050% or less. A lower limit of the content of each of Ca, Mg, and REM is not particularly specified. However, Ca, Mg, and REM are all elements that spheroidize the shape of nitrides and sulfides and improve the ultimate deformability of the steel sheet. Therefore, the content of each of Ca, Mg, and REM is respectively preferably 0.0005% or more.

Zr: 0.100% or Less, Te: 0.100% or Less

Excessive Zr and Te content causes an increase in coarse precipitates and inclusions and a reduction in the ultimate deformability of the steel sheet. Therefore, λ decreases. Further, bendability also decreases. Therefore, the content of each of Zr and Te is respectively 0.100% or less. The content of each of Zr and Te is respectively preferably 0.080% or less. A lower limit of the content of each of Zr and Te is not particularly specified. However, Zr and Te are both elements that spheroidize the shape of nitrides and sulfides and improve the ultimate deformability of the steel sheet. Therefore, the content of each of Zr and Te is respectively preferably 0.001% or more.

Hf: 0.10% or Less

Excessive Hf content causes an increase in coarse precipitates and inclusions and a reduction in the ultimate deformability of the steel sheet. Therefore, λ decreases. Further, bendability also decreases. Therefore, the Hf content is 0.10% or less. The Hf content is preferably 0.08% or less. A lower limit of the Hf content is not particularly specified. However, Hf is an element that spheroidizes the shape of nitrides and sulfides and improves the ultimate deformability of the steel sheet. Therefore, the Hf content is preferably 0.01% or more.

Bi: 0.200% or Less

Excessive Bi content causes an increase in coarse precipitates and inclusions and a reduction in the ultimate deformability of the steel sheet. Therefore, λ decreases. Further, bendability also decreases. Therefore, the Bi content is 0.200% or less. The Bi content is preferably 0.100% or less. A lower limit of the Bi content is not particularly specified. However, Bi is an element that reduces segregation. Therefore, the Bi content is preferably 0.001% or more.

When the content of each of O, Ti, Nb, V, Ta, W, B, Cr, Mo, Ni, Co, Cu, Sn, Sb, Ca, Mg, REM, Zr, Te, Hf, and Bi described above is below the respective preferred lower limit, the effect of the present disclosure is not harmed, and therefore these elements are included as inevitable impurity.

Steel microstructure of the base steel sheet of the hot-dip galvanized steel sheet according to an embodiment of the present disclosure is described below.

In the steel microstructure of the base steel sheet of the hot-dip galvanized steel sheet according to an embodiment of the present disclosure, at the ¼ sheet thickness position of the base steel sheet, area ratio of martensite: 70% or more, area ratio of ferrite: 10% or less, and area ratio of retained austenite: 0.5% or more and less than 10.0%, wherein, among crystal grains constituting the retained austenite, the number ratio of crystal grains having an aspect ratio of 2.0 or less is more than 50%, a number of bins having a frequency of 0.25 or more in a histogram of hardness distribution at the ¼ sheet thickness position of the base steel sheet is 1, and in terms of Vickers hardness, a class range of bins in the histogram is from more than $(n-1)\times20+450$ to $n\times20+450$ or less, where n is an integer from 1 to 10, in a surface layer of the base steel sheet, the area ratio of quenched martensite is 80% or less, where the surface layer of the base steel sheet is a region from the surface of the base steel sheet to a depth of 10 μm, and surface layer softening thickness of the base steel sheet is 10 μm or more and 100 μm or less.

Area ratio of martensite at ¼ sheet thickness position of base steel sheet: 70% or more When martensite is the main phase in the steel microstructure of the base steel sheet, and specifically when the area ratio of martensite at the ¼ sheet thickness position of the base steel sheet thickness is 70% or more, achieving a TS of 1,180 MPa or more and high stretch flangeability becomes possible. Therefore, the area ratio of martensite at the ¼ sheet thickness position of the base steel sheet is 70% or more. The area ratio of martensite at the ¼ sheet thickness position of the base steel sheet is preferably 75% or more. The area ratio of martensite at the ¼ sheet thickness position of the base steel sheet is more preferably 80% or more. The area ratio of martensite at the ¼ sheet thickness position of the base steel sheet is even more preferably 85% or more. An upper limit of the area ratio of martensite at the ¼ sheet thickness position of the base steel sheet is not particularly limited. From the viewpoint of obtaining high ductility, the following ranges are preferred. The area ratio of martensite at the ¼ sheet thickness position of the base steel sheet is preferably 99% or less. The area ratio of martensite at the ¼ sheet thickness position of the base steel sheet is more preferably 98% or less. The area ratio of martensite at the ¼ sheet thickness position of the base steel sheet is even more preferably 97% or less. Martensite here includes tempered martensite and bainite in addition to quenched martensite (fresh martensite).

Area ratio of ferrite at ¼ sheet thickness position of base steel sheet: 10% or less YR increases when the area ratio of ferrite at the ¼ sheet thickness position of the base steel sheet is 10% or less. Further, λ increases and bendability improves. Therefore, the area ratio of ferrite at the ¼ sheet thickness position of the base steel sheet is 10% or less. The area ratio of ferrite at the ¼ sheet thickness position of the base steel sheet is preferably 8% or less. The area ratio of ferrite at the ¼ sheet thickness position of the base steel sheet may be 0%. However, from the viewpoint of improving ductility, the area ratio of ferrite at the ¼ sheet thickness position of the base steel sheet is preferably 1% or more. The area ratio of ferrite at the ¼ sheet thickness position of the base steel sheet is more preferably 2% or more. Ferrite here may be defined as bainitic ferrite.

Here, the area ratios of martensite and ferrite at the ¼ sheet thickness position of the base steel sheet are measured as follows.

A sample is cut such that an observation plane is a thickness cross section (L-section) parallel to the rolling direction of the base steel sheet. The observation plane of the sample is then mirror polished using diamond paste, followed by finish polishing using colloidal silica. The observation plane of the sample is then etched with 3 vol % nital to reveal the microstructure. Then, on the observation plane of the sample, a scanning electron microscope (SEM) equipped with an in-lens detector is used to observe three fields of view of the base steel sheet at the ¼ sheet thickness position (that is, the ¼ sheet thickness position is the center position of the field of view in the thickness direction), under a set of conditions including accelerating voltage: 1 kV, magnification: 5,000×, and field of view: 17 μm×23 μm. From the obtained microstructure images, the areas of martensite and ferrite are calculated using Adobe Photoshop, sold by Adobe Systems. Then, for each field of view, and for each of martensite and ferrite, the area calculated is divided by the area of the field of view (17 μm×23 μm), and the arithmetic mean of values respectively obtained is the area ratio of martensite or ferrite.

In the microstructure images, each phase is distinguishable from each other by the following features. Quenched martensite has a convex microstructure and a fine internal concavity and convexity. Tempered martensite and bainite have concave microstructures that include fine carbides. Ferrite has a concave, flat, carbide-free microstructure.

Area ratio of retained austenite at ¼ sheet thickness position of base steel sheet: 0.5% or more and less than 10.0%

A desired E1 may be achieved by including a certain amount of retained austenite in the steel microstructure of the base steel sheet. To achieve this effect, the area ratio of retained austenite at the ¼ sheet thickness position of the base steel sheet is 0.5% or more. On the other hand, when the area ratio of retained austenite at the ¼ sheet thickness position of the base steel sheet is 10.0% or more, achieving a desired YR becomes difficult. Therefore, the area ratio of retained austenite at the ¼ sheet thickness position of the base steel sheet is 0.5% or more and less than 10.0%. The area ratio of retained austenite at the ¼ sheet thickness position of the base steel sheet is preferably 1.0% or more. The area ratio of retained austenite at the ¼ sheet thickness position of the base steel sheet is more preferably 1.5% or more. The area ratio of retained austenite at the ¼ sheet thickness position of the base steel sheet is preferably 8.0% or less. The area ratio of retained austenite at the ¼ sheet thickness position of the base steel sheet is more preferably 6.0% or less.

Here, the area ratio of retained austenite at the ¼ sheet thickness position of the base steel sheet is measured as follows.

The steel sheet is ground so that the observation plane is the ¼ sheet thickness position from the surface of the steel sheet (the position corresponding to ¼ of the sheet thickness in the depth direction from the surface of the steel sheet), and then further 0.1 mm polished by chemical polishing. Then, the integrated reflection intensities of the (200), (220), and (311) planes of fcc iron (austenite) and the (200), (211), and (220) planes of bcc iron are measured on the observation plane using an X-ray diffraction device with a Co Kα source. The volume fraction of austenite is determined from the intensity ratio of the integrated reflection intensity from each plane of fcc iron (austenite) to the integrated reflection intensity from each plane of bcc iron. The volume fraction of austenite is then considered to be uniform in three dimensions, and is taken as the area ratio of retained austenite at the ¼ sheet thickness position of the base steel sheet.

The area ratio of residual microstructure other than martensite, ferrite, and retained austenite is preferably 5% or less at the ¼ sheet thickness position of the base steel sheet. The residual microstructure includes other known microstructures of steel sheets, such as pearlite, cementite, metastable carbides (epsilon (ε) carbides, eta (η) carbides, chi (χ) carbides, and the like), and the like. Identification of the residual microstructure may be performed, for example, by observation with a scanning electron microscope (SEM).

The area ratio of the residual microstructure is calculated by the following formula.

$$[\text{area ratio of residual microstructure } (\%)] = 100 - [\text{area ratio of martensite } (\%)] - [\text{area ratio of ferrite } (\%)] - [\text{area ratio of retained austenite } (\%)]$$

At ¼ sheet thickness position of base steel sheet, among crystal grains constituting retained austenite, number ratio of crystal grains having aspect ratio of 2.0 or less (hereinafter also referred to as number ratio of retained austenite (γ) having aspect ratio of 2.0 or less): more than 50%

The number ratio of γ having an aspect ratio of 2.0 or less is a very important condition. By reducing the aspect ratio (major axis length/minor axis length) of the crystal grains constituting retained austenite, that is, by increasing the number ratio of crystal grains that are near equiaxed, the transformation from retained austenite to martensite in the initial stage of deformation is suppressed, and YR may be increased. To achieve such an effect, the number ratio of γ having an aspect ratio of 2.0 or less needs to be more than 50%. The larger the number ratio of γ having an aspect ratio of 2.0 or less, the better. The number ratio of γ having an aspect ratio of 2.0 or less is preferably 60% or more. The number ratio of γ having an aspect ratio of 2.0 or less is more preferably 70% or more.

Here, the number ratio of γ having an aspect ratio of 2.0 or less is measured as follows.

A sample having a thickness of 300 μm is machined so that the observation plane is at the ¼ sheet thickness position from the surface layer of the steel sheet (the position corresponding to ¼ of the sheet thickness in the depth direction from the surface of the steel sheet). Subsequently, the sample thinned by a twin-jet electropolishing method is measured by transmission electron backscatter diffraction (EBSD). Transmission EBSD measurements are performed under measurement conditions sufficient to evaluate retained austenite (measurement field of view: 15 μm×15 μm, measurement point spacing: 20 nm, accelerating voltage: 20 kV), and three fields of view are observed. From obtained crystal orientation data, bcc phase information is first removed by using OIM Analysis, sold by AMETEK Co., Ltd., with the phase set to Iron-Gamma only. Then, for the obtained crystal orientation data, confidence index (CI)>0.1 is set as a threshold value. Then, according to grain shape aspect ratio, the aspect ratio of the crystal grains of retained austenite and the number ratio (number fraction) of γ having an aspect ratio of 2.0 or less are calculated.

Number of bins having a frequency of 0.25 or more in histogram of hardness distribution at ¼ sheet thickness position of base steel sheet (hereinafter also referred to as number of bins of hardness frequency: 0.25 or more): 1

Number of bins of hardness frequency: 0.25 or more is a very important condition. When the number of bins of hardness frequency: 0.25 or more is 1, or in other words, when hardness of the base steel sheet is made sufficiently uniform, YR may be increased by the reduction in variation in the hardness of the base steel sheet. Further, λ and bendability improve. Therefore, the number of bins of hardness frequency: 0.25 or more is 1. The class range of bins of the histogram of hardness distribution at the ¼ sheet thickness position of the base steel sheet is from more than (n−1)×20+450 to n×20+450 or less in Vickers hardness HV, where n is an integer from 1 to 10.

The number of bins of hardness frequency: 0.25 or more is measured as follows.

A sample is cut such that a test surface is a thickness cross section (L-section) parallel to the rolling direction of the base steel sheet. Then, the test surface of the sample is mirror polished using diamond paste. At the ¼ sheet thickness position of the base steel sheet of the test surface of the sample, 50 measurement points of Vickers hardness HV are measured using a micro-Vickers hardness meter under a load of 5 gf. Then, a histogram of hardness distribution is created by setting the class range of bins to be from more than (n−1)×20+450 to n×20+450 or less in Vickers hardness HV, where n is an integer from 1 to 10, and the number of bins having a frequency of 0.25 or more in the created histogram is counted. The frequency of each bin is the number of Vickers hardness HV measurement results classified into each bin divided by the total number of Vickers hardness HV measurements (50). For example, when 10 results are measured to be in the range of Vickers hardness HV from more than 450 to 470 or less, the frequency of the bin in the class range from more than 450 to 470 or less is 0.20 (10÷50).

Area Ratio of Quenched Martensite (Fresh Martensite) in Surface Layer of Base Steel Sheet: 80% or Less The area ratio of quenched martensite in the surface layer of the base steel sheet is a very important condition. Desired bendability may be achieved by decreasing the area ratio of quenched martensite in the surface layer of the base steel sheet, or in other words, by increasing the area ratio of phases having low hydrogen solubility such as ferrite, bainitic ferrite, bainite, and tempered martensite in the surface layer of the base steel sheet. Further, increasing the area ratio of phases having low hydrogen solid solubility in the surface layer of the base steel sheet also contributes to reducing the amount of low temperature range diffusible hydrogen in the base steel sheet, described later. Further, El may also be increased. Further, λ may be improved. To achieve these effects, the area ratio of quenched martensite in the surface layer of the base steel sheet is 80% or less. The area ratio of quenched martensite in the surface layer of the base steel sheet is preferably 75% or less. The area ratio of quenched martensite in the surface layer of the base steel sheet is more preferably 70% or less. A lower limit of the area ratio of quenched martensite in the surface layer of the base steel sheet is not particularly limited. From the viewpoint of achieving the desired TS, the area ratio of quenched martensite in the surface layer of the base steel sheet is preferably 20% or more. The area ratio of quenched martensite in the surface layer of the base steel sheet is more preferably 30% or more. The surface layer of the base steel sheet is a region from the surface of the base steel sheet to a depth of 10 μm.

Here, the area ratio of quenched martensite in the surface layer of the base steel sheet is measured as follows.

A sample is cut such that an observation plane is a thickness cross section (L-section) parallel to the rolling direction of the base steel sheet. Then, the observation plane of the sample is polished. The observation plane of the sample is then etched with 3 vol % nital to reveal the microstructure. The surface layer of the base steel sheet is then set as an observation position, and observed using a scanning electron microscope (SEM) at a magnification of 3,000× for three fields of view. From the obtained microstructure image, the area of quenched martensite is calculated for the three fields of view using Adobe Photoshop, sold by Adobe Systems. Then, for each field of view, the area of quenched martensite is divided by the area of the field of view, and the arithmetic mean of values obtained is the area ratio of quenched martensite in the surface layer of the base steel sheet. In the microstructure images described above, quenched martensite exhibits a white microstructure.

The area ratio of residual microstructure other than quenched martensite in the surface layer of the base steel sheet is preferably 20% or more. The area ratio of residual microstructure other than quenched martensite in the surface layer of the base steel sheet is more preferably 25% or more. The area ratio of residual microstructure other than quenched martensite in the surface layer of the base steel sheet is even more preferably 30% or more. The area ratio of residual microstructure other than quenched martensite in the surface layer of the base steel sheet is preferably 80% or less. The area ratio of residual microstructure other than quenched martensite in the surface layer of the base steel sheet is more preferably 70% or less. The residual microstructure other than quenched martensite in the surface layer of the base metal, is basically composed of phases such as ferrite, bainitic ferrite, bainite, and tempered martensite. As long as the area ratio is 5% or less, other known steel sheet microstructure may be included, for example, carbides such as pearlite, cementite, metastable carbides (epsilon (ε) carbides, eta (η) carbides, chi (χ) carbides, and the like), and the like. Identification of the residual microstructure may be performed, for example, by observation with a scanning electron microscope (SEM).

The area ratio of the residual microstructure is calculated by the following formula.

$$[\text{area ratio of residual microstructure } (\%)] = 100 - [\text{area ratio of quenched martensite } (\%)]$$

Surface layer softening thickness of base steel sheet: 10 μm or more and 100 μm or less.

Desired bendability is obtainable by softening the surface layer of the base steel sheet compared to the ¼ sheet thickness position of the base steel sheet. Therefore, the surface layer softening thickness of the base steel sheet is preferably 10 μm or more. On the other hand, when the surface layer softening thickness of the base steel sheet exceeds 100 μm, TS may decrease. Therefore, the surface layer softening thickness of the base steel sheet is preferably 10 μm or more and 100 μm or less. The surface layer softening thickness of the base steel sheet is more preferably 12 μm or more. The surface layer softening thickness of the base steel sheet is even more preferably 15 μm or more. The surface layer softening thickness of the base steel sheet is more preferably 80 μm or less. The surface layer softening thickness is even more preferably 60 μm or less.

Here, the surface layer softening thickness is measured as follows.

A sheet thickness section (L-section) parallel to the rolling direction of the base steel sheet is smoothed by wet polishing. Then, using a Vickers hardness tester, hardness is measured at 5 μm intervals in the thickness (depth) direction from a position 10 μm deep from the surface of the base steel sheet to a mid-thickness position of the base steel sheet under a load of 5 gf. The hardness obtained at the ¼ sheet thickness position of the base steel sheet is used as a reference hardness, and the distance (depth) from the surface of the base steel sheet to the deepest depth position where the hardness is the reference hardness×0.85 or less is measured, and the measured value is the surface layer softening thickness.

The steel microstructure of the base metal sheet is typically vertically symmetrical in the thickness direction, and therefore measured values for either main surface (front or back surface) of the base steel sheet may be considered representative. This is true for the identification of microstructure at the ¼ sheet thickness position and in the surface layer of the base metal sheet, and the measurement of the number ratio of γ having an aspect ratio of 2.0 or less, the number of bins of hardness frequency: 0.25 or more, and the surface layer softening thickness of the base metal sheet. For example, either of the main surfaces (front or back surface) of the base steel sheet may be used as an initiation point of the thickness position (thickness 0 position) for the ¼ sheet thickness position. The same applies hereafter.

Further, in the hot-dip galvanized steel sheet according to an embodiment of the present disclosure, appropriately controlling the amount of low temperature range diffusible hydrogen in the base steel sheet is very important.

Low temperature range diffusible hydrogen in base steel sheet: 0.015 mass ppm or less The amount of low temperature range diffusible hydrogen in the base steel sheet is a very important condition. The inventors have made intensive studies to obtain a hot-dip galvanized steel sheet that has a high YR, as well as high ductility, stretch flangeability, and bendability, improved shear workability, and a TS of 1,180 MPa or more. As a result, the inventors found that the amount of low temperature range diffusible hydrogen in the base steel sheet, that is, the amount of hydrogen released from the base steel sheet when heated from room temperature to 50° C., significantly affects the above properties, in particular shear workability. The inventors have found that shear workability depends more on the amount of hydrogen released in a low temperature range, specifically from room temperature to 50° C., than on the amount of hydrogen released in a high temperature range when the base steel sheet is heated. Further, the inventors found that reducing the amount of low temperature range diffusible hydrogen in the base steel sheet, in particular to 0.015 mass ppm or less, is essential in order to significantly improve shear workability while maintaining high YR, high ductility, stretch flangeability, and bendability, leading to the present disclosure. Therefore, the amount of low temperature range diffusible hydrogen in the base steel sheet is 0.015 mass ppm or less. The lower the amount of low temperature range diffusible hydrogen in the base steel sheet, the better. The amount of low temperature range diffusible hydrogen in the base steel sheet is preferably 0.010 mass ppm or less. The amount of low temperature range diffusible hydrogen in the base steel sheet is more preferably 0.006 mass ppm or less. A lower limit of the amount of low temperature range diffusible hydrogen in the base steel sheet is not particularly limited, and may be 0 mass ppm. However, due to production technology constraints, the amount of low temperature range diffusible hydrogen in the base steel sheet is preferably 0.001 mass ppm or more.

Here, the amount of low temperature range diffusible hydrogen in the base steel sheet is measured as follows.

A test piece 30 mm in length and 5 mm in width is collected from a central position of a sample of hot-dip galvanized steel sheet by shearing. Immediately after collection, the test piece is immersed in liquid nitrogen. Then, the galvanized layer of the test piece is removed with alkali while controlling the temperature of the treatment solution so that the surface temperature of the test piece is below room temperature. The amount of hydrogen released from the test piece when heated is then measured by a thermal desorption analysis method. Specifically, the test piece is heated from room temperature to an end-point temperature of 300° C. at a heating rate of 200° C./h, and then cooled to room temperature. A cumulative amount of hydrogen released from the test piece in the temperature range from room temperature to 50° C. during heating (hereinafter also referred to as cumulative hydrogen released) is measured. Then, the amount of low temperature range diffusible hydrogen in the base steel sheet is calculated using the following formula.

$$[\text{low temperature range diffusible hydrogen in base steel sheet (mass ppm)}] = [\text{cumulative hydrogen released (g)}]/[\text{mass of test piece (g)}] \times 10^6$$

Room temperature in the range of 10° C. to 25° C. does not have any particular effect on the measurement of the amount of low temperature range diffusible hydrogen in the base steel sheet. However, when the room temperature is outside the range of 10° C. to 25° C., 25° C. is used to represent room temperature, and the cumulative hydrogen released from the test piece in the temperature range from 25° C. to 50° C. is measured.

For a hot-dip galvanized steel sheet that has undergone processing such as punching, stretch flange forming, and bending, as well as for products (members) manufactured by welding steel sheets after such processing, the amount of low temperature range diffusible hydrogen in the base steel sheet is measured in the same way as described above.

The thickness of the base steel sheet of the hot-dip galvanized steel sheet according to an embodiment of the present disclosure is not particularly limited. The thickness of the base steel sheet is typically 0.3 mm or more and 2.8 mm or less.

[1-2] Galvanized Layer

Next, the galvanized layer of the hot-dip galvanized steel sheet according to an embodiment of the present disclosure is described below. The galvanized layer here also includes a galvannealed layer (a layer obtained by applying an alloying treatment to a galvanized layer). The galvanized layer is provided on both sides of the base steel sheet.

The composition of the galvanized layer is not particularly limited and may be a typical composition. An example composition contains: Fe: 20 mass % or less, Al: 0.001 mass % or more and 1.0 mass % or less, and at least one selected from the group consisting of Pb, Sb, Si, Sn, Mg, Mn, Ni, Cr, Co, Ca, Cu, Li, Ti, Be, Bi, and REM in total being 0 mass % or more and 3.5 mass % or less, with the balance being Zn and inevitable impurity. In the case of a (non-alloyed) galvanized layer, as one example, the Fe content in the coated layer is less than 7 mass %. In the case of a galvannealed layer, as one example, the Fe content in the coated layer is 7 mass % or more and 15 mass % or less. The Fe content in the coated layer is more preferably 8 mass % or more. The Fe content in the coated layer is more preferably 13 mass % or less.

The coating weight per side is not particularly limited. The coating weight per side is preferably 20 g/m$^2$ to 80 g/m$^2$.

In addition, the galvanized layer preferably has cracks. By intentionally imparting cracks to the galvanized layer, the amount of low temperature diffusible hydrogen in the base steel sheet may be further reduced. The presence or absence of cracks in the galvanized layer is determined as follows. Surfaces (front surface and back surface) of the galvanized layer of a hot-dip galvanized steel sheet are observed by SEM at a magnification of 1500× with two fields of view for each surface, for a total of four fields of view. When one or more cracks having a length of 10 μm or more is present in any of the above four fields of view, the galvanized layer is judged to have cracks. Where there are no cracks having a length of 10 μm or more in all of the above four fields of view, the galvanized layer is judged to be crack-free.

[1-3] Other Features

Tensile Strength (TS): 1,180 MPa or More

The TS of the hot-dip galvanized steel sheet according to an embodiment of the present disclosure is 1,180 MPa or more. TS is measured in accordance with JIS Z 2241, as described with reference to the Examples below.

The thickness of the galvanized steel sheet according to an embodiment of the present disclosure is not particularly limited. The thickness of the galvanized steel sheet is typically 0.3 mm or more and 2.8 mm or less.

[2] Method for Producing Hot-Dip Galvanized Steel Sheet

The method for producing the galvanized steel sheet according to an embodiment of the present disclosure is described below.

The method for producing the hot-dip galvanized steel sheet according to an embodiment of the present disclosure comprises:

- applying a hot rolling process to a steel slab having the chemical composition described above to obtain a hot-rolled steel sheet, under a set of conditions including:
- coiling temperature: 350° C. or more and 600° C. or less, and
- holding time in a temperature range of 300° C. or more in post-coiling cooling: 5000 s or more;
- pickling the hot-rolled steel sheet;
- applying a first heat treatment to the hot-rolled steel sheet, under a set of conditions including:
- heat treatment temperature: 450° C. or more and 650° C. or less, and
- holding time in a temperature range of 400° C. or more to the heat treatment temperature or less: 10 min or more;
- cold rolling the hot-rolled steel sheet to obtain a cold-rolled steel sheet;
- annealing the cold-rolled steel sheet, under a set of conditions including:
- average heating rate in a temperature range of 250° C. or more to 700° C. or less: 10° C./s or more,
- oxygen concentration in a temperature range of 250° C. or more to 700° C. or less: 0.5 vol % or more and 5.0 vol % or less,
- annealing temperature: 820° C. or more and 950° C. or less, and
- dew point at annealing temperature range: −35° C. or more;
- applying a hot-dip galvanizing treatment to the cold-rolled steel sheet to produce a galvanized steel sheet;
- cooling the galvanized steel sheet under a set of conditions including cooling stop temperature: 150° C. or less; and
- applying a second heat treatment to the galvanized steel sheet under a set of conditions satisfying the following Formula (1):

$$6.5 \leq (T + 273) \times \{\log(t \times 3600) + 20\}/1000 \leq 13.0 \quad \text{(Formula 1)}$$

where T is the heat treatment temperature in the second heat treatment (° C.) and t is the heat holding time in the second heat treatment (h).

Further, the method for producing the hot-dip galvanized steel sheet according to an embodiment of the present disclosure is also a method for producing the hot-dip galvanized steel sheet according to an embodiment of the present disclosure described above.

Unless otherwise specified, all of the above temperatures are based on the surface temperature of the steel slab or steel sheet.

[Hot Rolling Process]

First, the steel slab is hot rolled to obtain a hot-rolled steel sheet. A method of preparing the steel slab (steel material) is not particularly limited, and any known method, such as use of a converter, an electric furnace, and the like may be applied. Further, the steel slab is preferably produced by continuous casting to help prevent macro-segregation. Further, the steel slab may be produced by ingot casting or thin slab casting. In addition to a conventional method of cooling the steel slab to room temperature once after production and then heating again, an energy-saving process such as hot charging, direct rolling, and the like may also be applied. Hot charging is a process in which a warm slab is charged into a furnace without cooling to room temperature. Direct rolling is a process of immediate rolling after a very short hold.

When the steel slab is heated, the slab heating temperature is preferably 1,100° ° C. or more from a viewpoint of carbide dissolution and reduction of rolling load. Further, the slab heating temperature is preferably 1,300° C. or less, in order to prevent increased scale loss. The slab heating temperature is the temperature of the slab surface.

The steel slab is then rough rolled into a sheet bar under typical conditions. When the slab heating temperature is low, heating the sheet bar using a bar heater or the like before finish rolling is preferable, from the viewpoint of preventing trouble during rolling. The rolling finish temperature is preferably the $Ar_3$ transformation temperature or more. Excessively lowering the rolling finish temperature leads to increased rolling load and higher rolling reduction in an un-recrystallized state of austenite. This may lead to the development of an abnormal microstructure elongated in the rolling direction, resulting in reduced workability of the steel sheet obtained after annealing. The $Ar_3$ transformation temperature is determined by the following formula.

$$Ar_3(^\circ C.) = 868 - 396 \times [\% C] + 24.6 \times [\% Si] - 68.1 \times [\% Mn] - 36.1 \times [\% Ni] - 20.7 \times [\% Cu] - 24.8 \times [\% Cr]$$

[% element symbol] in the above formula represents the content (mass %) of the element in the chemical composition described above.

Sheet bars may be joined together for continuous finish rolling. Further, a sheet bar may be temporarily coiled. Further, at least part of finish rolling may be conducted as lubrication rolling to reduce rolling load. Conducting lubrication rolling in such a manner is effective in terms of making shape and material property of a steel sheet uniform. In lubrication rolling, the coefficient of friction is preferably 0.10 or more. The coefficient of friction is preferably 0.25 or less.

In the hot rolling process, controlling the coiling temperature and the holding time in a temperature range of 300° ° C. or more during post-coiling cooling is particularly important.

Coiling Temperature: 350° C. or More and 600° C. or Less

In the hot rolling process, after finish rolling, the hot rolled sheet is coiled and collected, and then cooled. At this time, by setting the coiling temperature at 350° C. or more, C diffuses into oxide scale formed during rolling. In other words, decarburization of the surface layer of the hot-rolled steel sheet is promoted, and the surface layer softening thickness of the base steel sheet and the area ratio of martensite in the surface layer of the base steel sheet may be controlled within desired ranges. Accordingly, high bendability may be obtained. Further, the area ratio of martensite in the surface layer of the base steel sheet decreases, which also decreases the amount of low temperature diffusible hydrogen in the base steel sheet. As a result, excellent E1, λ, and shear workability may be obtained. Further, the steel microstructure of the hot-rolled steel sheet becomes mainly a low temperature transformation phase, and the number of bins of hardness frequency: 0.25 or more may be controlled to be 1. As a result, YR also increases. However, when the coiling temperature exceeds 600° C., the surface layer softening thickness of the base steel sheet increases, making achieving a TS of 1,180 MPa or more difficult. Further, the steel microstructure of the hot-rolled steel sheet does not become mainly a low temperature transformation phase, making controlling the number of bins of hardness frequency: 0.25 or more to be 1 difficult. As a result, achieving desired YR, 2, and bendability becomes difficult. Therefore, the coiling temperature is 350° C. or more and 600° C. or less. The coiling temperature is preferably 380° C. or more. The coiling temperature is more preferably 410° C. or more. Further, the coiling temperature is preferably 570° C. or less. The coiling temperature is more preferably 550° C. or less.

Holding time in the temperature range of 300° C. or more in post-coiling cooling (hereinafter also referred to as holding time in the temperature range of 300° ° C. or more): 5,000 s or more After coiling a hot-rolled steel sheet, the hot-rolled steel sheet is held in a temperature range of 300° C. or more for 5,000 s or more. Accordingly, C diffuses into the oxide scale formed during rolling. In other words, decarburization of the surface layer of the hot-rolled steel sheet is promoted, and the surface layer softening thickness of the base steel sheet and the area ratio of martensite in the surface layer of the base steel sheet may be controlled within desired ranges. Accordingly, high bendability may be obtained. Further, the area ratio of martensite in the surface layer of the base steel sheet decreases, which also decreases the amount of low temperature diffusible hydrogen in the base steel sheet. As a result, excellent E1, 2, and shear workability may be obtained. Therefore, the holding time in the temperature range of 300° C. or more is 5,000 s or more. The holding time in the temperature range of 300° C. or more is preferably 7,000 s or more. The holding time in the temperature range of 300° C. or more is more preferably 9,000 s or more. An upper limit of the holding time in the temperature range of 300° C. or more is not particularly specified. From the viewpoint of keeping TS within the specified range, the holding time in the temperature range of 300° C. or more is preferably 100,000 s or less. The holding time in the temperature range of 300° C. or more is more preferably 80,000 s or less. The holding time in the temperature range of 300° C. or more is even more preferably 40,000 s or less. The initiation point of the holding time in the temperature range of 300° C. or more is the time when the hot-rolled steel sheet is coiled (completion of coiling). As long as the holding temperature is in the temperature range of 300° C. or more, the holding temperature is not particularly limited. The holding temperature is preferably 350° C. or more. The holding temperature is preferably 600° C. or less.

The cooling conditions after holding in the temperature range of 300° C. or more described above are not particularly limited and a conventional method may be followed. For example, a cooling rate of 0.001° C./s or more and 1° C./s or less is preferred. A cooling stop temperature of 20° C. or more and 200° C. or less is preferred.

[Pickling Process]

After the hot rolling process, the hot-rolled steel sheet is pickled. Pickling may remove oxides from the steel sheet surface, securing good chemical convertibility and coating quality. Pickling may be performed in one or more batches. Pickling conditions are not particularly limited, and a conventional method may be followed.

[First Heat Treatment Process]

Then, the first heat treatment is applied to the hot-rolled steel sheet. At this time, satisfying the following conditions is important.

Heat Treatment Temperature: 450° C. or More and 650° C. or Less

By applying heat treatment to the hot-rolled steel sheet, fine carbides are uniformly formed in the steel microstructure of the hot-rolled steel sheet, and the number of bins of hardness frequency: 0.25 or more may be controlled to be 1. To obtain these effects, the heat treatment temperature needs to be 450° C. or more. On the other hand, when the heat treatment temperature exceeds 650° C., carbides become spherical and coarse, and pearlite is formed. Accordingly, controlling the number of bins of hardness frequency: 0.25 or more to be 1 becomes difficult. Therefore, the heat treatment temperature is 450° C. or more and 650° C. or less. The heat treatment temperature is preferably 460° C. or more. The heat treatment temperature is more preferably 470° C. or more. The heat treatment temperature is preferably 600° C. or less. The heat treatment temperature is more preferably 550° C. or less.

Holding Time in Temperature Range of 400° C. or More and Heat Treatment Temperature or Less (Hereinafter Also Referred to as Holding Time in Heat Treatment Temperature Range): 10 Min or More By setting the holding time in the heat treatment temperature range to 10 min or more, fine carbides are uniformly formed in the steel microstructure of the hot-rolled steel sheet, and the number of bins of hardness frequency: 0.25 or more may be controlled to be 1. Therefore, the holding time in the heat treatment temperature range is 10 min or more. The holding time in the heat treatment temperature range is preferably 100 min or more. The holding time in the heat treatment temperature range is more preferably 500 min or more. An upper limit of the holding time in the heat treatment temperature range is not particularly limited. From the viewpoint of uniform formation of fine carbides in the steel microstructure of the hot-rolled steel sheet, the holding time in the heat treatment temperature range is preferably 3,000 min or less. The holding time in the heat treatment temperature range is more preferably 2,000 min or less.

[Cold Rolling Process]

The hot-rolled steel sheet is then subjected to cold rolling to obtain a cold-rolled steel sheet. Cold rolling conditions are not particularly limited, and a conventional method may be followed.

For example, cold rolling with two or more rolling passes is performed by tandem-type multi-stand rolling, reverse rolling, and the like. The accumulated rolling reduction ratio of cold rolling is preferably 20% or more, for example. The accumulated rolling reduction ratio of cold rolling is preferably 75% or less, for example. The number of rolling passes and the rolling reduction of each pass are not particularly limited and a conventional method may be followed.

[Annealing Process]

The cold-rolled steel sheet obtained as described above is then annealed. At this time, satisfying the following conditions is important.

Average Heating Rate in Temperature Range of 250° C. or More and 700° ° C. or Less (Hereinafter Also Referred to as Heating Temperature Range): 10° C./s or More By increasing the average heating rate in the heating temperature range, austenite formed during heating is refined and the number of bins of hardness frequency: 0.25 or more may be controlled to be 1. Therefore, the average heating rate in the heating temperature range is 10° C./s or more. The average heating rate in the heating temperature range is preferably 12° C./s or more. The average heating rate in the heating temperature range is more preferably 14° C./s or more. Further, an upper limit of the average heating rate in the heating temperature range is not particularly specified. In view of production technology constraints, the following ranges are preferred. The average heating rate in the heating temperature range is preferably 50° C./s or less. The average heating rate in the heating temperature range is more preferably 40° C./s or less.

Oxygen Concentration in Heating Temperature Range: 0.5 Vol % or More and 5.0 Vol % or Less By increasing the oxygen concentration in the heating temperature range, decarburization proceeds via oxygen in the atmosphere, forming a softened layer in the surface layer of the steel sheet. As a result, desired bendability may be achieved. Further, the area ratio of martensite in the surface layer of the base steel sheet decreases, and the amount of low temperature diffusible hydrogen in the base steel sheet decreases. To obtain these effects, the oxygen concentration in the heating temperature range is 0.5 vol % or more. On the other hand, when the oxygen concentration in the heating temperature range exceeds 5.0 vol %, the surface layer softening thickness of the base steel sheet increases, making achieving a TS of 1,180 MPa or more difficult. Therefore, the oxygen concentration in the heating temperature range is 0.5 vol % or more and 5.0 vol % or less. The oxygen concentration in the heating temperature range is preferably 1.0 vol % or more. The oxygen concentration in the heating temperature range is more preferably 1.5 vol % or more. The oxygen concentration in the heating temperature range is preferably 4.5 vol % or less. The oxygen concentration in the heating temperature range is more preferably 4.0 vol % or less. The temperature in the heating temperature range is based on the surface temperature of the steel sheet. In other words, the oxygen concentration is adjusted to a range described above when the surface temperature of the steel sheet is in the heating temperature range.

Annealing Temperature: 820° C. or More and 950° C. or Less

When the annealing temperature is less than 820° C., the annealing treatment occurs in a two-phase region of ferrite and austenite. In such a case, a large amount of ferrite is contained in the annealed steel sheet, making achieving the desired YR, 2, and bendability difficult. On the other hand, when the annealing temperature exceeds 950° C., the austenite crystal grains coarsen non-uniformly during annealing, making controlling the number of bins of hardness frequency: 0.25 or more to be 1 difficult. As a result, achieving desired YR, A, and bendability becomes difficult. Therefore, the annealing temperature is 820° C. or more and 950° C. or less. The annealing temperature is preferably 850° C. or more. The annealing temperature is more preferably 870° C. or more. The annealing temperature is preferably 930° C. or less. The annealing temperature is more preferably 920° C. or less. The annealing temperature is the maximum arrival temperature during the annealing process.

Dew Point in Annealing Temperature Range: −35° C. or More

By increasing the dew point in the annealing temperature range (temperature range of 820° C. or more and 950° C. or less), decarburization proceeds via oxygen in the atmosphere, forming a softened layer in the surface layer of the steel sheet. As a result, desired bendability may be achieved. Further, the area ratio of martensite in the surface layer of the base steel sheet decreases, and the amount of low temperature diffusible hydrogen in the base steel sheet decreases. To obtain these effects, the dew point in the annealing temperature range is −35° C. or more. The dew point in the annealing temperature range is preferably −30° C. or more. The dew point in the annealing temperature range is more preferably −25° C. or more. An upper limit of the dew point in the annealing temperature range is not particularly limited. From the viewpoint of controlling the surface layer softening thickness of the base steel sheet in a defined range and securing a defined TS, the following ranges are preferred. The dew point in the annealing temperature range is preferably 15° C. or less. The dew point in the annealing temperature range is more preferably 5° C. or less. The temperature in the annealing temperature range is based on the surface temperature of the steel sheet. In other words, the dew point is adjusted to a range described above when the surface temperature of the steel sheet is in the annealing temperature range. The same is true for oxygen concentration, which is described later.

The holding time in the annealing temperature range (hereinafter also referred to as annealing time) and oxygen concentration are not particularly limited. From the viewpoint of controlling the surface layer softening thickness of the base steel sheet and the area ratio of martensite in the surface layer of the base steel sheet in defined ranges, the following ranges are preferred. The annealing time is preferably 10 s or more. The annealing time is preferably 600 s or less. The oxygen concentration is preferably 2 volume ppm or more. The oxygen concentration is preferably 30 volume ppm or less. Further, the temperature during holding does not always have to be constant.

After the annealing, the cold-rolled steel sheet is cooled. At this time, conditions are not particularly limited, and a conventional method may be used. For example, the average cooling rate in a temperature range of the annealing temperature or more and 500° C. or less is not particularly limited. From the viewpoint of controlling the number of bins of hardness frequency: 0.25 or more, the following range is preferred. The average cooling rate is preferably 5° C./s or more. The average cooling rate is preferably 50° C./s or less.

[Coating Treatment Process]

The cold-rolled steel sheet is then subjected to a coating treatment to produce a coated steel sheet. As the coating treatment, hot-dip galvanizing treatment is an example. Further, alloying treatment may be applied after the hot-dip galvanizing treatment. In addition, annealing, cooling, and coating may be performed continuously in one line (continuous galvanizing line (CGL)). For example, after annealing, the cold-rolled steel sheet is cooled to a temperature range of about 500° C. The cold-rolled steel sheet is then passed through to a steel strip output side of the cooling zone, and is further cooled while being moved to a hot-dip galvanizing bath via a snout, a lead end of which is immersed in the hot-dip galvanizing bath. The time from the end of cooling of the cold-rolled steel sheet until the cold-rolled steel sheet enters the hot-dip galvanizing bath is not particularly limited. From the viewpoint of controlling the number of bins of hardness frequency: 0.25 or more, the following range is preferred. The time is preferably 1 s or more. The time is preferably 300 s or less. Just before a connection between the cooling zone and the snout, a roll is provided to change the travel direction of the cold-rolled steel sheet and to cause entry into the snout. After passing the roll, the cold-rolled steel sheet enters the snout. The cold-rolled steel sheet is then guided through the snout to the hot-dip galvanizing bath, where the cold-rolled steel sheet is dipped into the hot-dip galvanizing bath and galvanized to become a coated steel sheet.

In the hot-dip galvanizing treatment, for example, the cold-rolled steel sheet is immersed in the hot-dip galvanizing bath at a temperature of 440° C. or more and 500° C. or less. Further, use of a hot-dip galvanizing bath having a composition consisting of Al content of 0.10 mass % or more and 0.23 mass % or less, with the balance being Zn and inevitable impurity, is preferable.

Further, after the hot-dip galvanizing treatment as described above, an alloying treatment in a temperature range of 460° C. or more to 600° C. or less may be applied. When the alloying treatment temperature is less than 460° C., the Zn—Fe alloying rate is excessively slow and productivity is reduced. On the other hand, when the alloying treatment temperature exceeds 600° C., untransformed austenite may transform to pearlite, resulting in a decrease in TS and E1. Therefore, the alloying treatment temperature is preferably 460° C. or more. The alloying treatment temperature is preferably 600° C. or less. The alloying treatment temperature is more preferably 470° C. or more. The alloying treatment temperature is more preferably 560° C. or less.

Further, the coating weight is preferably 20 g/m$^2$ to 80 g/m$^2$ per side (in the case of double-sided coating). The coating weight may be adjusted by gas wiping or the like after the hot-dip galvanizing treatment.

<Cooling Process>

After the coating treatment, that is, after the hot-dip galvanizing treatment or the alloying treatment, the coated steel sheet is cooled under a set of conditions including a cooling stop temperature of 150° C. or less.

Cooling Stop Temperature: 150° C. or Less

When the cooling stop temperature exceeds 150° C., controlling the number of bins of hardness frequency: 0.25 or more to be 1 becomes difficult. As a result, achieving desired YR, 2, and bendability becomes difficult. Therefore, the cooling stop temperature is 150° C. or less. The cooling stop temperature is preferably 100° C. or less. A lower limit of the cooling stop temperature is not particularly specified. From the viewpoint of productivity, the cooling stop temperature is preferably room temperature or more.

Cooling conditions other than the above are not particularly limited, and a conventional method may be used. For example, the average cooling rate from the end of the hot-dip galvanizing treatment or the alloying treatment to the cooling stop temperature is not particularly limited. From the viewpoint of further improvement of TS, the following ranges are preferred. The average cooling rate is preferably 2° C./s or more. The average cooling rate is more preferably 5° C./s or more. In view of production technology constraints, the following ranges are preferred. The average cooling rate is preferably 50° C./s or less. The average cooling rate is more preferably 40° C./s or less. Further, the cooling method is also not particularly limited, and gas jet cooling, mist cooling, water cooling, and air cooling may be applied.

After the cooling described above, the coated steel sheet is preferably subjected to additional rolling with an elongation rate of 0.05% or more and 1.00% or less. An elongation rate of 0.05% or more in the additional rolling may introduce cracks in the galvanized layer. As a result, a further reduction in the amount of low temperature range diffusible hydrogen in the base steel sheet may be expected. Further, the number ratio of γ having an aspect ratio of 2.0 or less increases, which further improves YS. On the other hand, when the elongation rate from the additional rolling exceeds 1.00%, the area ratio of retained austenite may decrease and E1 may decrease. Therefore, the elongation rate of the additional rolling is preferably 0.05% or more. The elongation rate of the additional rolling is preferably 1.00% or less. The elongation of the additional rolling is more preferably 0.10% or more. The elongation of the additional rolling is more preferably 0.50% or less.

The additional rolling described above may be performed on equipment that is continuous with continuous hot-dip galvanizing apparatus (online) or on equipment that is discontinuous with the continuous hot-dip galvanizing apparatus (offline). The target elongation rate may be achieved in a single rolling or more than one rolling operation may be performed to achieve a total elongation rate of 0.05% or more and 1.00% or less. The rolling described here generally refers to temper rolling, but a method of processing by a tension leveler or the like is also acceptable as long as the method provides an elongation rate equivalent to that of temper rolling.

[Second Heat Treatment]

Next, applying a second heat treatment to the coated steel sheet under a Set of Conditions Satisfying the Following Formula (1) is Important.

$$6.5 \leq (T+273) \times \{\log(t \times 3600)+20\}/1000 \leq 13.0 \quad \text{(Formula 1)}$$

where T is the heat treatment temperature in the second heat treatment (° C.) and t is the heat holding time in the second heat treatment (h).

In other words, the amount of low temperature diffusible hydrogen in the base steel sheet may be reduced by applying the second heat treatment under a set of conditions that satisfy the above Formula (1). Further, the number ratio of γ having an aspect ratio of 2.0 or less increases. To obtain these effects, (T+273)×{log(tx 3600)+20}/1000 needs to be 6.5 or more. On the other hand, when (T+273)×{log(tx 3600)+20}/1000 exceeds 13.0, the area ratio of retained austenite decreases and achieving a desired E1 becomes difficult. Therefore, applying the second heat treatment under a set of conditions that satisfy the above Formula (1) is important. (t+273)×{log(t×3600)+20}/1000 is preferably 6.8 or more. (t+273)×{log(t×3600)+20}/1000 is more preferably 7.0 or more. Further, (t+273)×{log(t×3600)+20}/1000 is preferably 12.5 or less. (t+273)×{log(t×3600)+20}/1000 is more preferably 12.0 or less. Further, log in the above Formula (1) is the common logarithm with base 10.

The heat treatment temperature in the second heat treatment is the maximum arrival temperature in the second heat treatment. Further, the holding time in the second heat treatment is the holding time in a temperature range from the heat treatment temperature−15° C. to the heat treatment temperature in the second heat treatment.

The cooling conditions after holding temperature in the second heat treatment are not particularly limited and a conventional method may be followed. For example, gas jet cooling, mist cooling, water cooling, air cooling, and the like may be applied as cooling methods.

Further, additional rolling may be performed after the second heat treatment described above. The elongation rate of the additional rolling is preferably 0.05% or more. The elongation rate of the additional rolling is preferably 1.00% or less. The target elongation rate may be achieved in a single rolling or more than one rolling operation may be performed to achieve a total elongation rate of 0.05% or more and 1.00% or less. The rolling described here generally refers to temper rolling, but a method of processing by a tension leveler or the like is also acceptable as long as the method provides an elongation rate equivalent to that of temper rolling.

When the hot-dip galvanized steel sheet is to be traded, the hot-dip galvanized steel sheet is typically cooled to room temperature before being traded.

Production conditions other than those described above are not particularly limited, and a conventional method may be used.

[3] Member

A member according to an embodiment of the present disclosure is described below.

The member according to an embodiment of the present disclosure is a member made using the hot-dip galvanized steel sheet according to an embodiment of the present disclosure described above. The member according to an embodiment of the present disclosure is, for example, the hot-dip galvanized steel sheet according to an embodiment of the present disclosure described above, formed into a desired shape by press working or the like. The member according to an embodiment of the present disclosure is suitable for an automobile frame structural part or for an automobile reinforcing part.

Here, the hot-dip galvanized steel sheet according to an embodiment of the present disclosure is a hot-dip galvanized steel sheet that has a high YR, as well as high ductility, stretch flangeability, and bendability, improved shear workability, and a TS of 1,180 MPa or more. Therefore, the member according to an embodiment of the present disclosure is able to contribute to excellent dimensional accuracy and weight reduction of an automotive body, and is suitable for use particularly as an automobile frame structural part or generally as an automobile reinforcing part.

Examples

Steel slabs (steel material) having the chemical compositions listed in Table 1 each with the balance consisting of Fe and inevitable impurity were melted in a converter, and steel slabs were obtained by continuous casting. The obtained steel slabs were heated to 1,250° C. and rough rolled to obtain sheet bars. The obtained sheet bars were then subjected to finish rolling at a rolling finish temperature of 900° C. Coiling and cooling were performed under the conditions listed in Table 2 to obtain hot-rolled steel sheets. The obtained hot-rolled steel sheets were then pickled, then subjected to the first heat treatment and cold rolling under the conditions listed in Table 2 to obtain cold-rolled steel sheets each having a thickness of 1.4 mm.

The obtained cold-rolled steel sheets were then annealed under the conditions listed in Table 2. The cold-rolled steel sheets were then subjected to the types of coating treatment listed in Table 2 to obtain coated steel sheets (having galvanized layers on both sides). In Table 2, GI as a type of coating treatment means that only a hot-dip galvanizing treatment was performed (a galvanized steel sheet without alloying treatment was obtained), and GA means a hot-dip galvanizing treatment+an alloying treatment were performed (a galvannealed steel sheet was obtained).

In the case of GI, a hot-dip galvanizing bath was used as the coating bath that had a composition of Al: 0.20 mass %, with the balance being Zn and inevitable impurity. In the case of GA, a hot-dip galvanizing bath was used that had a composition of Al: 0.14 mass %, with the balance being Zn and inevitable impurity. The coating bath temperature was 470° C. in both cases. The coating weight was about 45 g/m$^2$ to 72 g/m$^2$ per side (double-sided coating) for GI and 45 g/m$^2$ per side (double-sided coating) for GA. In GA, the alloying treatment temperature was set at about 550° C.

In the case of GI, the composition of the galvanized layer was Fe: 0.1 mass % to 1.0 mass %, Al: 0.2 mass % to 1.0 mass %, with the balance being Zn and inevitable impurity. In the case of GA, the composition of the (alloyed) galvanized layer was Fe: 7 mass % to 15 mass %, Al: 0.1 mass % to 1.0 mass %, with the balance being Zn and inevitable impurity.

The obtained coated steel sheets were then cooled under the conditions listed in Table 2, and after cooling, the coated steel sheets were subjected to the second heat treatment under the conditions listed in Table 2. For conditions not specified, conventional methods were followed.

The methods described above were used on the obtained steel sheets to identify the microstructure at the ¼ sheet thickness position of the base steel sheet, and to measure the number ratio of γ having an aspect ratio of 2.0 or less, the number of bins of hardness frequency: 0.25 or more, the surface layer softening thickness of the base steel sheet, and the amount of low temperature diffusible hydrogen of the base steel sheet. Results are listed in Table 3. The chemical compositions of the base steel sheets of the obtained steel sheets were practically the same as that at the steel slab stage. For conforming steel, the chemical compositions were all within the ranges of the chemical compositions according to the embodiments described above, while for comparative steel, the chemical compositions were all outside the ranges of the chemical compositions described for the embodiments.

The obtained steel sheets were evaluated for tensile properties, stretch flangeability, bendability, and shear workability, according to the following test methods. The results are listed in Table 3.

[Tensile Test]

Tensile testing was performed in accordance with JIS Z 2241. That is, from the obtained steel sheets, JIS No. 5 test pieces were taken so that the direction orthogonal to the rolling direction (C direction) was the longitudinal direction. The test pieces were then subjected to tensile testing at a crosshead speed of $1.67\times10^{-1}$ mm/s to measure YS, TS, and E1. For TS, a value of 1,180 MPa or more was judged to be acceptable (pass). From the measured YS and TS, YR was calculated using the above Formula (2). A YR of 65% or more was judged to be acceptable (pass). An E1 of 6% or more was judged to be acceptable (pass).

[Hole Expanding Test]

The hole expanding test was performed in accordance with JIS Z 2256. Each of the obtained steel sheets was sheared to 100 mm×100 mm, and then a hole of 10 mm in diameter was punched through the sheared steel sheet with a clearance of 12.5%. Then, a die having an inside diameter of 75 mm was used to hold the steel sheet with a blank holding force of 9 tonnes (88.26 kN), and a conical punch having a top angle of 60° was pushed into the hole to measure the hole diameter at the crack initiation limit. The (maximum) hole expansion ratio: 2(%) was obtained by the following formula.

$$\text{(maximum) hole expansion ratio: } \lambda(\%) = \{(D_f - D_0)/D_0\} \times 100$$

where Dr is the hole diameter (mm) at crack initiation and Do is the initial hole diameter (mm). Then, stretch flangeability was judged to be acceptable (pass) when the (maximum) hole expansion ratio: λ was 30% or more.

[Bend Test]

The bend test was performed in accordance with JIS Z 2248. That is, test pieces of strips 30 mm wide and 100 mm long were taken from the obtained steel sheets so that a direction parallel to the rolling direction of the base steel sheet was the axial direction of the bend test. Then, a 90° V-bend test was performed under a set of conditions including a pushing load of 100 kN and a holding time of 5 s. Here, for each steel sheet, the bend test was performed on five samples with R/t, the value obtained by dividing the bend radius (R) by the sheet thickness (t), being 5 (for example, when the sheet thickness is 1.4 mm, the bend radius is 7.0 mm). Then, the presence or absence of cracks at the ridge of the tip of the bend test sample was checked, and when no cracks were observed in all five samples, that is, when the pass rate was 100%, the bendability was judged to be acceptable (pass). Here, the presence or absence of cracks was determined by checking the ridge at the tip of the bend test sample using a digital microscope (RH-2000, manufactured by Hirox Co. Ltd.) at 40× magnification.

[Shearing Test]

From each of the obtained steel sheets, a test piece 114 mm in width (direction orthogonal to the rolling direction) and 32 mm in length (rolling direction) was obtained by shearing by a crank press so that the shear separation surface was in the direction orthogonal to the rolling direction of the base steel sheet. The shear conditions of the crank press were as follows: shear angle: 0.5 degrees and clearance: 20%. The test piece was then cross sectioned parallel to the rolling direction so that the center of the width of the strip was the observation position. The cross section of the test piece was then polished and corroded with a solution of picric acid with added Lipon F (sold by Lion hygiene Corporation). The shear separation surface of the test piece was then observed using an optical microscope at 25× magnification. When no cracks were observed in the image obtained, the shear workability was judged to be acceptable (pass).

TABLE 1

| Steel sample | Chemical composition (mass %) | | | | | | | | | | | | | | | | |
|---|---|---|---|---|---|---|---|---|---|---|---|---|---|---|---|---|---|
| ID | C | Si | Mn | P | S | Al | N | O | Ti | Nb | V | Ta | W | B | Cr | Mc | Ni |
| A | 0.215 | 1.07 | 3.18 | 0.028 | 0.0007 | 0.027 | 0.0038 | — | — | — | — | — | — | — | — | — | — |
| B | 0.294 | 0.48 | 3.05 | 0.020 | 0.0033 | 0.040 | 0.0032 | — | — | — | — | — | — | — | — | — | — |
| C | 0.106 | 0.64 | 3.07 | 0.023 | 0.0009 | 0.048 | 0.0028 | — | — | — | — | — | — | — | — | — | — |
| D | 0.352 | 0.97 | 3.13 | 0.045 | 0.0048 | 0.040 | 0.0028 | — | — | — | — | — | — | — | — | — | — |
| E | 0.247 | 0.51 | 2.99 | 0.046 | 0.0019 | 0.039 | 0.0026 | — | — | — | — | — | — | — | — | — | — |
| F | 0.078 | 0.91 | 3.04 | 0.028 | 0.0032 | 0.038 | 0.0039 | — | — | — | — | — | — | — | — | — | — |
| G | 0.116 | 2.59 | 3.18 | 0.041 | 0.0002 | 0.039 | 0.0027 | — | — | — | — | — | — | — | — | — | — |
| H | 0.116 | 1.16 | 1.93 | 0.020 | 0.0016 | 0.050 | 0.0032 | — | — | — | — | — | — | — | — | — | — |
| I | 0.114 | 1.15 | 4.21 | 0.006 | 0.0008 | 0.048 | 0.0027 | — | — | — | — | — | — | — | — | — | — |
| J | 0.209 | 0.68 | 3.16 | 0.013 | 0.0036 | 0.032 | 0.0027 | 0.0011 | 0.042 | — | — | — | — | — | — | — | — |
| K | 0.151 | 1.17 | 3.09 | 0.011 | 0.0038 | 0.021 | 0.0048 | — | — | 0.022 | — | — | — | — | — | — | — |
| L | 0.195 | 0.54 | 2.91 | 0.030 | 0.0017 | 0.021 | 0.0028 | — | — | — | 0.016 | — | — | — | — | — | — |
| M | 0.203 | 0.96 | 2.83 | 0.006 | 0.0023 | 0.035 | 0.0038 | — | — | — | — | 0.02 | 0.03 | — | — | — | — |
| N | 0.253 | 1.02 | 3.05 | 0.032 | 0.0011 | 0.028 | 0.0031 | — | — | 0.034 | — | 0.03 | — | — | — | — | — |
| O | 0.208 | 0.93 | 3.17 | 0.009 | 0.0006 | 0.037 | 0.0041 | — | 0.022 | — | — | — | — | 0.0027 | — | — | — |
| P | 0.241 | 1.05 | 3.06 | 0.014 | 0.0032 | 0.048 | 0.0034 | — | — | — | — | — | — | — | 0.33 | — | — |
| Q | 0.180 | 0.61 | 3.31 | 0.005 | 0.0036 | 0.032 | 0.0038 | — | — | — | — | — | — | — | — | 0.08 | — |
| R | 0.242 | 0.68 | 3.09 | 0.014 | 0.0014 | 0.039 | 0.0027 | — | — | — | — | — | — | — | — | — | 0.09 |
| S | 0.182 | 0.85 | 3.08 | 0.008 | 0.0037 | 0.045 | 0.0025 | — | — | — | — | — | — | — | — | — | — |
| T | 0.202 | 0.81 | 3.07 | 0.036 | 0.0011 | 0.044 | 0.0048 | — | — | — | — | — | — | — | — | — | — |

TABLE 1-continued

| | | | | | | | | | | | | | | | | | |
|---|---|---|---|---|---|---|---|---|---|---|---|---|---|---|---|---|---|
| U | 0.148 | 1.15 | 3.14 | 0.005 | 0.0030 | 0.044 | 0.0039 | — | — | — | — | — | — | — | — | — | — |
| V | 0.367 | 0.55 | 3.18 | 0.023 | 0.0038 | 0.039 | 0.0040 | — | — | — | — | — | — | — | — | — | — |
| W | 0.177 | 0.97 | 3.16 | 0.031 | 0.0002 | 0.029 | 0.0043 | — | — | — | — | — | — | — | — | — | — |
| X | 0.171 | 0.96 | 3.07 | 0.038 | 0.0002 | 0.021 | 0.0043 | — | — | — | — | — | — | — | — | — | — |
| Y | 0.117 | 0.54 | 3.13 | 0.027 | 0.0019 | 0.032 | 0.0039 | — | — | — | — | — | — | — | — | — | — |
| Z | 0.219 | 0.81 | 3.16 | 0.034 | 0.0003 | 0.022 | 0.0039 | — | — | — | — | — | — | — | — | — | — |
| a | 0.209 | 0.15 | 2.96 | 0.048 | 0.0038 | 0.028 | 0.0038 | — | 0.019 | 0.021 | — | — | — | 0.0008 | — | — | — |
| b | 0.203 | 0.29 | 2.82 | 0.027 | 0.0031 | 0.029 | 0.0046 | — | 0.026 | 0.007 | — | — | — | 0.0030 | — | — | — |
| c | 0.189 | 0.45 | 2.68 | 0.009 | 0.0008 | 0.043 | 0.0043 | — | 0.017 | 0.012 | — | — | — | 0.0025 | — | — | — |
| d | 0.190 | 0.83 | 2.79 | 0.010 | 0.0012 | 0.020 | 0.0029 | — | 0.022 | 0.015 | — | — | — | 0.0017 | — | — | — |
| e | 0.188 | 1.50 | 2.55 | 0.029 | 0.0036 | 0.025 | 0.0041 | — | — | — | — | — | — | — | — | — | — |
| f | 0.215 | 0.77 | 2.20 | 0.003 | 0.0014 | 0.032 | 0.0033 | — | — | — | — | — | — | — | — | — | — |
| g | 0.219 | 0.54 | 3.60 | 0.035 | 0.0026 | 0.041 | 0.0039 | — | — | — | — | — | — | — | — | — | — |

| Steel sample | Chemical composition (mass %) | | | | | | | | | | | |
|---|---|---|---|---|---|---|---|---|---|---|---|---|
| ID | Co | Cu | Sn | Sb | Ca | Mg | REM | Zr | Te | Hf | Bi | Remarks |
| A | — | — | — | — | — | — | — | — | — | — | — | Conforming steel |
| B | — | — | — | — | — | — | — | — | — | — | — | Conforming steel |
| C | — | — | — | — | — | — | — | — | — | — | — | Conforming steel |
| D | — | — | — | — | — | — | — | — | — | — | — | Conforming steel |
| E | — | — | — | — | — | — | — | — | — | — | — | Conforming steel |
| F | — | — | — | — | — | — | — | — | — | — | — | Comparative steel |
| G | — | — | — | — | — | — | — | — | — | — | — | Comparative steel |
| H | — | — | — | — | — | — | — | — | — | — | — | Comparative steel |
| I | — | — | — | — | — | — | — | — | — | — | — | Comparative steel |
| J | — | — | — | — | — | — | — | — | — | — | — | Conforming steel |
| K | — | — | — | — | — | — | — | — | — | — | — | Conforming steel |
| L | — | — | — | — | — | — | — | — | — | — | — | Conforming steel |
| M | — | — | — | — | — | — | — | — | — | — | — | Conforming steel |
| N | — | — | — | — | — | — | — | — | — | — | — | Conforming steel |
| O | — | — | — | — | — | — | — | — | — | — | — | Conforming steel |
| P | — | — | — | — | — | — | — | — | — | — | — | Conforming steel |
| Q | — | — | — | — | — | — | — | — | — | — | — | Conforming steel |
| R | — | — | — | — | — | — | — | — | — | — | — | Conforming steel |
| S | 0.007 | — | — | — | — | — | — | — | — | — | — | Conforming steel |
| T | — | 0.13 | — | — | — | — | — | — | — | — | — | Conforming steel |
| U | — | — | 0.009 | — | — | — | — | — | — | — | — | Conforming steel |
| V | — | — | — | 0.013 | — | — | — | — | — | — | — | Conforming steel |
| W | — | — | — | — | 0.0003 | — | — | — | — | — | — | Conforming steel |
| X | — | — | — | — | — | 0.0009 | 0.0021 | — | — | — | — | Conforming steel |
| Y | — | — | — | — | — | — | — | 0.042 | — | — | — | Conforming steel |
| Z | — | — | — | — | — | — | — | — | 0.002 | 0.02 | 0.003 | Conforming steel |
| a | — | — | — | — | — | — | — | — | — | — | — | Conforming steel |
| b | — | — | — | — | — | — | — | — | — | — | — | Conforming steel |
| c | — | — | — | — | — | — | — | — | — | — | — | Conforming steel |
| d | — | — | — | — | — | — | — | — | — | — | — | Conforming steel |
| e | — | — | — | — | — | — | — | — | — | — | — | Conforming steel |
| f | — | — | — | — | — | — | — | — | — | — | — | Conforming steel |
| g | — | — | — | — | — | — | — | — | — | — | — | Conforming steel |

Underlined: indicates outside the scope of disclosure

TABLE 2

| | | Hot rolling conditions | | First heat treatment conditions | | Annealing conditions | | | | |
|---|---|---|---|---|---|---|---|---|---|---|
| No. | Steel sample ID | Coiling temp. (° C.) | Hold time in temp. range of 300° C. or more (s) | Heat treatment temp. (° C.) | Hold time in temp. range of heat treatment (min) | Average heating rate in heating temp. range (° C./s) | Oxygen concentration in heating temp. range (vol %) | Annealing temp. (° C.) | Dew point in annealing temp. range (° C.) | Coating treatment conditions Type |
| 1 | A | 450 | 20000 | 510 | 800 | 20 | 2.0 | 880 | −10 | GA |
| 2 | B | 490 | 20000 | 450 | 1300 | 40 | 2.5 | 910 | −5 | GA |
| 3 | C | 500 | 10000 | 500 | 1000 | 20 | 3.0 | 880 | −20 | GA |
| 4 | C | 300 | 10000 | 500 | 1000 | 20 | 2.0 | 880 | −20 | GA |
| 5 | C | 700 | 10000 | 500 | 1000 | 20 | 2.0 | 880 | −20 | GA |
| 6 | C | 500 | 2000 | 500 | 1000 | 20 | 2.0 | 880 | −20 | GA |
| 7 | C | 500 | 10000 | 350 | 1000 | 20 | 2.0 | 880 | −20 | GA |
| 8 | C | 500 | 10000 | 700 | 1000 | 20 | 2.0 | 880 | −20 | GA |
| 9 | C | 500 | 10000 | 500 | 1 | 20 | 2.0 | 880 | −20 | GA |
| 10 | C | 500 | 10000 | 500 | 1000 | 5 | 2.0 | 880 | −20 | GA |
| 11 | C | 500 | 10000 | 500 | 1000 | 20 | 0.2 | 880 | −20 | GA |
| 12 | C | 500 | 10000 | 500 | 1000 | 20 | 6.0 | 880 | −20 | GA |

TABLE 2-continued

| | | | | | | | | | | |
|---|---|---|---|---|---|---|---|---|---|---|
| 13 | C | 500 | 10000 | 500 | 1000 | 20 | 2.0 | 750 | −20 | GA |
| 14 | C | 500 | 10000 | 500 | 1000 | 20 | 2.0 | 1000 | −20 | GA |
| 15 | C | 500 | 10000 | 500 | 1000 | 20 | 2.0 | 880 | −45 | GA |
| 16 | C | 500 | 10000 | 500 | 1000 | 20 | 2.0 | 880 | −20 | GA |
| 17 | C | 500 | 10000 | 500 | 1000 | 20 | 2.0 | 880 | −20 | GA |
| 18 | D | 550 | 8000 | 490 | 1500 | 18 | 2.0 | 820 | −30 | GA |
| 19 | E | 490 | 20000 | 510 | 800 | 10 | 1.5 | 910 | −25 | GA |
| 20 | F | 530 | 20000 | 520 | 1200 | 18 | 3.0 | 900 | −15 | GI |
| 21 | G | 530 | 20000 | 520 | 1200 | 18 | 3.0 | 900 | −15 | GA |
| 22 | H | 530 | 20000 | 520 | 1200 | 18 | 3.0 | 900 | −15 | GA |
| 23 | I | 530 | 20000 | 520 | 1200 | 18 | 3.0 | 900 | −15 | GA |
| 24 | J | 490 | 20000 | 450 | 1500 | 12 | 2.0 | 890 | −25 | GA |
| 25 | K | 530 | 30000 | 550 | 800 | 17 | 1.5 | 910 | −35 | GA |
| 26 | L | 480 | 9000 | 510 | 1500 | 48 | 2.0 | 900 | −25 | GA |
| 27 | M | 550 | 20000 | 470 | 500 | 16 | 3.0 | 890 | −10 | GA |
| 28 | N | 480 | 30000 | 560 | 1300 | 23 | 2.5 | 840 | −30 | GA |
| 29 | O | 450 | 20000 | 550 | 500 | 16 | 4.0 | 940 | −30 | GA |
| 30 | P | 500 | 30000 | 490 | 800 | 24 | 3.0 | 890 | −10 | GA |
| 31 | Q | 490 | 9000 | 510 | 1500 | 15 | 2.0 | 900 | −25 | GA |
| 32 | R | 450 | 20000 | 490 | 500 | 14 | 3.5 | 920 | −25 | GA |
| 33 | S | 550 | 9000 | 450 | 800 | 14 | 3.0 | 870 | −30 | GA |
| 34 | T | 490 | 30000 | 510 | 1300 | 25 | 2.5 | 910 | −10 | GA |
| 35 | U | 450 | 20000 | 570 | 800 | 14 | 2.0 | 930 | −30 | GA |
| 36 | V | 500 | 100000 | 470 | 1500 | 26 | 3.0 | 890 | −5 | GA |
| 37 | W | 490 | 20000 | 510 | 1300 | 31 | 2.5 | 920 | −10 | GA |
| 38 | X | 490 | 20000 | 570 | 2000 | 27 | 1.5 | 890 | −25 | GA |
| 39 | Y | 530 | 20000 | 450 | 800 | 34 | 2.0 | 900 | −10 | GI |
| 40 | Z | 450 | 20000 | 510 | 800 | 27 | 2.0 | 870 | −10 | GA |
| 41 | C | 500 | 10000 | 600 | 10 | 20 | 3.0 | 880 | −20 | GA |
| 42 | a | 500 | 10000 | 500 | 1000 | 20 | 3.0 | 880 | −20 | GA |
| 43 | b | 500 | 10000 | 500 | 1000 | 20 | 3.0 | 880 | −20 | GA |
| 44 | c | 500 | 10000 | 500 | 1000 | 20 | 3.0 | 880 | −20 | GA |
| 45 | d | 530 | 20000 | 520 | 1200 | 18 | 3.0 | 900 | −15 | GI |
| 46 | e | 530 | 20000 | 520 | 1200 | 18 | 3.0 | 900 | −15 | GI |
| 47 | f | 530 | 20000 | 520 | 1200 | 18 | 3.0 | 900 | −15 | GI |
| 48 | g | 530 | 20000 | 520 | 1200 | 18 | 3.0 | 900 | −15 | GI |

| | | Second heat treatment conditions | | | |
|---|---|---|---|---|---|
| No. | Cooling conditions Cooling stop temp. (° C.) | Heat treatment temp. T (° C.) | Hold time t (h) | (T + 273) × {log(t × 3600) + 20}/1000 | Remarks |
| 1 | 50 | 100 | 10 | 9.2 | Example |
| 2 | 80 | 40 | 48 | 7.9 | Example |
| 3 | Room temp. | 20 | 4320 | 8.0 | Example |
| 4 | Room temp. | 20 | 4320 | 8.0 | Comparative Example |
| 5 | Room temp. | 20 | 4320 | 8.0 | Comparative Example |
| 6 | Room temp. | 20 | 4320 | 8.0 | Comparative Example |
| 7 | Room temp. | 20 | 4320 | 8.0 | Comparative Example |
| 8 | Room temp. | 20 | 4320 | 8.0 | Comparative Example |
| 9 | Room temp. | 20 | 4320 | 8.0 | Comparative Example |
| 10 | Room temp. | 20 | 4320 | 8.0 | Comparative Example |
| 11 | Room temp. | 20 | 4320 | 8.0 | Comparative Example |
| 12 | Room temp. | 20 | 4320 | 8.0 | Comparative Example |
| 13 | Room temp. | 20 | 4320 | 8.0 | Comparative Example |
| 14 | Room temp. | 20 | 4320 | 8.0 | Comparative Example |
| 15 | Room temp. | 20 | 4320 | 8.0 | Comparative Example |
| 16 | 200 | 20 | 4320 | 8.0 | Comparative Example |
| 17 | Room temp. | 5 | 0.1 | 6.3 | Comparative Example |
| 18 | Room temp. | 100 | 24 | 9.3 | Example |
| 19 | Room temp. | 80 | 48 | 8.9 | Example |
| 20 | 50 | 100 | 24 | 9.3 | Comparative Example |
| 21 | 50 | 100 | 24 | 9.3 | Comparative Example |
| 22 | 50 | 100 | 24 | 9.3 | Comparative Example |
| 23 | 50 | 100 | 24 | 9.3 | Comparative Example |
| 24 | Room temp. | 50 | 1440 | 8.6 | Example |
| 25 | 50 | 70 | 36 | 8.6 | Example |
| 26 | Room temp. | 120 | 4 | 9.5 | Example |
| 27 | 100 | 50 | 48 | 8.4 | Example |
| 28 | 50 | 70 | 24 | 8.6 | Example |
| 29 | 80 | 10 | 4320 | 7.7 | Example |
| 30 | 50 | 100 | 12 | 9.2 | Example |
| 31 | 50 | 150 | 3 | 10.2 | Example |
| 32 | Room temp. | 40 | 1440 | 8.4 | Example |
| 33 | Room temp. | 30 | 2160 | 8.1 | Example |
| 34 | Room temp. | 170 | 1 | 10.4 | Example |
| 35 | 80 | 180 | 4 | 10.9 | Example |

TABLE 2-continued

| | | | | | |
|---|---|---|---|---|---|
| 36 | 50 | 300 | 0.02 | 12.5 | Example |
| 37 | 80 | 80 | 4 | 8.5 | Example |
| 38 | 100 | 25 | 1080 | 7.9 | Example |
| 39 | 50 | 60 | 72 | 8.5 | Example |
| 40 | 50 | 90 | 10 | 8.9 | Example |
| 41 | Room temp. | 20 | 4320 | 8.0 | Example |
| 42 | Room temp. | 20 | 4320 | 8.0 | Example |
| 43 | Room temp. | 20 | 4320 | 8.0 | Example |
| 44 | Room temp. | 20 | 4320 | 8.0 | Example |
| 45 | 50 | 100 | 24 | 9.3 | Example |
| 46 | 50 | 100 | 24 | 9.3 | Example |
| 47 | 50 | 100 | 24 | 9.3 | Example |
| 48 | 50 | 100 | 24 | 9.3 | Example |

Underlined: indicates outside the scope of disclosure

TABLE 3

| | | Steel microstructure of base steel sheet | | | | | | | | |
|---|---|---|---|---|---|---|---|---|---|---|
| | | ¼ sheet thickness position | | | | Number ratio of | Number of bins | | | Surface |
| | | | α | | | γ having aspect | having hardness | Surface layer | | layer |
| No. | Steel sample ID | M area ratio (%) | area ratio (%) | γ area ratio (%) | Residual micro-structure | ratio of 2.0 or less (%) | frequency of 0.25 or more (No.) | Quenched M area ratio (%) | Residual micro-structure | softening thickness (μm) |
| 1 | A | 86 | 2 | 2.9 | θ | 86 | 1 | 62 | α + θ | 50 |
| 2 | B | 89 | 6 | 2.1 | θ | 78 | 1 | 47 | α + θ | 29 |
| 3 | C | 84 | 1 | 5.1 | θ | 68 | 1 | 59 | α + θ | 30 |
| 4 | C | 81 | 6 | 5.7 | θ | 72 | 2 | 99 | α + θ | 2 |
| 5 | C | 83 | 5 | 4.6 | θ | 63 | 2 | 51 | α + θ | 139 |
| 6 | C | 81 | 3 | 5.6 | θ | 81 | 2 | 96 | α + θ | 2 |
| 7 | C | 83 | 4 | 4.9 | θ | 74 | 2 | 59 | α + θ | 33 |
| 8 | C | 80 | 2 | 5.0 | θ | 63 | 2 | 58 | α + θ | 45 |
| 9 | C | 85 | 6 | 4.6 | θ | 75 | 2 | 66 | α + θ | 17 |
| 10 | C | 84 | 4 | 5.5 | θ | 88 | 2 | 65 | α + θ | 33 |
| 11 | C | 82 | 1 | 5.1 | θ | 80 | 1 | 99 | α + θ | 5 |
| 12 | C | 82 | 7 | 5.7 | θ | 63 | 1 | 60 | α + θ | 145 |
| 13 | C | 82 | 12 | 5.3 | θ | 71 | 1 | 62 | α + θ | 30 |
| 14 | C | 83 | 7 | 5.2 | θ | 83 | 2 | 40 | α + θ | 21 |
| 15 | C | 83 | 4 | 5.9 | θ | 67 | 1 | 94 | α + θ | 1 |
| 16 | C | 83 | 1 | 5.1 | θ | 86 | 2 | 50 | α + θ | 52 |
| 17 | C | 81 | 6 | 5.9 | θ | 21 | 1 | 63 | α + θ | 22 |
| 18 | D | 94 | 2 | 2.0 | θ | 60 | 1 | 46 | α + θ | 44 |
| 19 | E | 89 | 2 | 3.0 | θ | 85 | 1 | 35 | α + θ | 52 |
| 20 | F | 61 | 32 | 5.5 | θ | 88 | 1 | 43 | α + θ | 34 |
| 21 | G | 82 | 3 | 5.1 | θ | 32 | 1 | 54 | α + θ | 29 |
| 22 | H | 59 | 35 | 5.6 | θ | 80 | 1 | 44 | α + θ | 45 |
| 23 | I | 85 | 1 | 4.7 | θ | 70 | 2 | 35 | α + θ | 42 |
| 24 | J | 86 | 4 | 2.3 | θ | 89 | 1 | 41 | α + θ | 48 |
| 25 | K | 83 | 7 | 4.7 | θ | 72 | 1 | 65 | α + θ | 35 |
| 26 | L | 90 | 3 | 3.3 | θ | 60 | 1 | 31 | α + θ | 18 |
| 27 | M | 82 | 7 | 5.6 | θ | 84 | 1 | 67 | α + θ | 23 |
| 28 | N | 86 | 1 | 2.4 | θ | 75 | 1 | 65 | α + θ | 44 |
| 29 | O | 90 | 5 | 3.0 | θ | 72 | 1 | 32 | α + θ | 53 |
| 30 | P | 85 | 6 | 2.6 | θ | 81 | 1 | 57 | α + θ | 54 |
| 31 | Q | 88 | 4 | 3.6 | θ | 67 | 1 | 59 | α + θ | 59 |
| 32 | R | 86 | 3 | 4.3 | θ | 83 | 1 | 39 | α + θ | 35 |
| 33 | S | 89 | 2 | 2.9 | θ | 80 | 1 | 56 | α + θ | 37 |
| 34 | T | 85 | 6 | 4.3 | θ | 62 | 1 | 66 | α + θ | 37 |
| 35 | U | 81 | 0 | 4.7 | θ | 82 | 1 | 70 | α + θ | 38 |
| 36 | V | 93 | 5 | 1.3 | θ | 61 | 1 | 65 | α + θ | 30 |
| 37 | W | 87 | 1 | 4.3 | θ | 68 | 1 | 32 | α + θ | 46 |
| 38 | X | 87 | 8 | 2.1 | θ | 82 | 1 | 67 | α + θ | 31 |
| 39 | Y | 84 | 5 | 5.5 | θ | 73 | 1 | 59 | α + θ | 40 |
| 40 | Z | 88 | 3 | 4.1 | θ | 71 | 1 | 59 | α + θ | 43 |
| 41 | C | 85 | 7 | 5.7 | θ | 74 | 1 | 55 | α + θ | 28 |
| 42 | a | 86 | 6 | 4.4 | θ | 89 | 1 | 52 | α + θ | 36 |
| 43 | b | 88 | 5 | 4.0 | θ | 86 | 1 | 55 | α + θ | 36 |
| 44 | c | 88 | 4 | 4.1 | θ | 78 | 1 | 54 | α + θ | 37 |
| 45 | d | 86 | 4 | 2.7 | θ | 71 | 1 | 48 | α + θ | 42 |
| 46 | e | 85 | 3 | 3.5 | θ | 73 | 1 | 38 | α + θ | 40 |
| 47 | f | 88 | 5 | 2.2 | θ | 71 | 1 | 41 | α + θ | 49 |
| 48 | g | 89 | 1 | 2.3 | θ | 67 | 1 | 38 | α + θ | 43 |

TABLE 3-continued

| No. | Amount of low temp. range diffusible hydrogen in base steel sheet (mass ppm) | Mechanical properties YS (MPa) | TS (MPa) | YR (%) | El (%) | λ (%) | Bendability | Shear workability | Remarks |
|---|---|---|---|---|---|---|---|---|---|
| 1 | 0.003 | 1055 | 1481 | 71 | 8 | 59 | Pass | Pass | Example |
| 2 | 0.009 | 1471 | 1812 | 81 | 7 | 64 | Pass | Pass | Example |
| 3 | 0.009 | 834 | 1242 | 67 | 8 | 31 | Pass | Pass | Example |
| 4 | 0.018 | 1014 | 1202 | 84 | 5 | 17 | Fail | Fail | Comparative Example |
| 5 | 0.005 | 619 | 1059 | 58 | 8 | 25 | Fail | Pass | Comparative Example |
| 6 | 0.017 | 927 | 1278 | 73 | 5 | 19 | Fail | Fail | Comparative Example |
| 7 | 0.006 | 788 | 1241 | 63 | 8 | 27 | Fail | Pass | Comparative Example |
| 8 | 0.002 | 741 | 1207 | 61 | 8 | 26 | Fail | Pass | Comparative Example |
| 9 | 0.009 | 745 | 1229 | 61 | 7 | 26 | Fail | Pass | Comparative Example |
| 10 | 0.002 | 786 | 1233 | 64 | 7 | 28 | Fail | Pass | Comparative Example |
| 11 | 0.018 | 997 | 1217 | 82 | 4 | 49 | Fail | Fail | Comparative Example |
| 12 | 0.010 | 907 | 1070 | 85 | 8 | 31 | Pass | Pass | Comparative Example |
| 13 | 0.004 | 754 | 1280 | 59 | 10 | 13 | Fail | Pass | Comparative Example |
| 14 | 0.009 | 799 | 1265 | 63 | 8 | 26 | Fail | Pass | Comparative Example |
| 15 | 0.019 | 1100 | 1224 | 90 | 4 | 35 | Fail | Fail | Comparative Example |
| 16 | 0.006 | 752 | 1265 | 59 | 9 | 26 | Fail | Pass | Comparative Example |
| 17 | 0.017 | 739 | 1215 | 61 | 5 | 39 | Fail | Fail | Comparative Example |
| 18 | 0.004 | 1415 | 1971 | 72 | 9 | 55 | Pass | Pass | Example |
| 19 | 0.002 | 1496 | 1848 | 81 | 9 | 52 | Pass | Pass | Example |
| 20 | 0.006 | 905 | 1080 | 84 | 7 | 54 | Pass | Pass | Comparative Example |
| 21 | 0.003 | 778 | 1243 | 63 | 8 | 10 | Pass | Pass | Comparative Example |
| 22 | 0.008 | 759 | 1100 | 69 | 7 | 42 | Pass | Pass | Comparative Example |
| 23 | 0.004 | 704 | 1201 | 59 | 10 | 25 | Fail | Pass | Comparative Example |
| 24 | 0.010 | 1270 | 1529 | 83 | 7 | 40 | Pass | Pass | Example |
| 25 | 0.007 | 1230 | 1427 | 86 | 10 | 51 | Pass | Pass | Example |
| 26 | 0.003 | 1328 | 1509 | 88 | 7 | 61 | Pass | Pass | Example |
| 27 | 0.010 | 915 | 1389 | 66 | 7 | 57 | Pass | Pass | Example |
| 28 | 0.002 | 1527 | 1862 | 82 | 8 | 55 | Pass | Pass | Example |
| 29 | 0.007 | 1176 | 1600 | 74 | 9 | 47 | Pass | Pass | Example |
| 30 | 0.005 | 1487 | 1877 | 79 | 8 | 49 | Pass | Pass | Example |
| 31 | 0.006 | 1199 | 1784 | 67 | 7 | 37 | Pass | Pass | Example |
| 32 | 0.008 | 1583 | 1897 | 83 | 7 | 44 | Pass | Pass | Example |
| 33 | 0.002 | 1341 | 1492 | 90 | 7 | 47 | Pass | Pass | Example |
| 34 | 0.003 | 1304 | 1481 | 88 | 6 | 49 | Pass | Pass | Example |
| 35 | 0.004 | 1126 | 1371 | 82 | 8 | 42 | Pass | Pass | Example |
| 36 | 0.009 | 1673 | 2036 | 82 | 8 | 54 | Pass | Pass | Example |
| 37 | 0.004 | 1030 | 1550 | 66 | 9 | 61 | Pass | Pass | Example |
| 38 | 0.007 | 1275 | 1584 | 80 | 10 | 39 | Pass | Pass | Example |
| 39 | 0.007 | 930 | 1191 | 78 | 6 | 58 | Pass | Pass | Example |
| 40 | 0.006 | 1267 | 1570 | 81 | 7 | 63 | Pass | Pass | Example |
| 41 | 0.006 | 915 | 1256 | 73 | 7 | 31 | Pass | Pass | Example |
| 42 | 0.005 | 1299 | 1526 | 85 | 7 | 44 | Pass | Pass | Example |
| 43 | 0.008 | 1274 | 1543 | 83 | 8 | 42 | Pass | Pass | Example |
| 44 | 0.006 | 1304 | 1502 | 87 | 7 | 63 | Pass | Pass | Example |
| 45 | 0.006 | 1214 | 1537 | 79 | 7 | 61 | Pass | Pass | Example |
| 46 | 0.002 | 1199 | 1541 | 78 | 9 | 41 | Pass | Pass | Example |
| 47 | 0.006 | 1215 | 1536 | 79 | 8 | 64 | Pass | Pass | Example |
| 48 | 0.006 | 1204 | 1502 | 80 | 8 | 49 | Pass | Pass | Example |

Underlined: indicates outside the scope of disclosure
M: martensite,
α: ferrite and/or bainitic ferrite,
γ: retained austenite,
θ: cementite and/or metastable carbide As indicated in Table 3, the Examples all had TS of 1,180 MPa or more, high YR, high ductility, high stretch flangeability, high bendability, and high shear workability.

On the other hand, at least one of TS, YR, ductility, stretch flangeability, bendability, and shear workability were not sufficient in the Comparative Examples.

Although embodiments of the present disclosure have been described above, the present disclosure is not limited to the embodiments described above. That is, a person skilled in the art may make various modifications to the embodiments, Examples, and operational techniques disclosed herein, and all such modifications still fall within the scope of the present disclosure. For example, in the above-described series of heat treatment processes of the production method disclosed herein, any apparatus or the like may be used to perform the processes on the steel sheet as long as the thermal hysteresis conditions are met.

INDUSTRIAL APPLICABILITY

According to the present disclosure, a hot-dip galvanized steel sheet is obtainable that has a high YR, as well as high ductility, stretch flangeability, and bendability, improved shear workability, and a TS of 1,180 MPa or more.

In particular, the hot-dip galvanized steel sheet according to the present disclosure has various superior properties and may be applied to automobile frame structural parts having various sizes and shapes. Accordingly, fuel efficiency may be improved by reducing automotive body weight, and industrial applicability is extremely high.

The invention claimed is:

1. A hot-dip galvanized steel sheet comprising a base steel sheet and a galvanized layer on a surface of the base steel sheet, and having a tensile strength of 1,180 MPa or more, wherein the base steel sheet has a chemical composition containing, in mass %, C: 0.090% or more and 0.390% or less, Si: 0.01% or more and 2.50% or less, Mn: 2.00% or more and 4.00% or less, P: 0.100% or less, S: 0.0200% or less, Al: 0.100% or less, and N: 0.0100% or less, with the balance being Fe and inevitable impurity, the steel microstructure comprising, at a ¼ sheet thickness position of the base steel sheet, area ratio of martensite: 70% or more, area ratio of ferrite: 10% or less, and area ratio of retained austenite: 0.5% or more and less than 10.0%, wherein, among crystal grains constituting the retained austenite, the number ratio of crystal grains having an aspect ratio of 2.0 or less is more than 50%, a number of bins having a frequency of 0.25 or more in a histogram of hardness distribution at the ¼ sheet thickness position of the base steel sheet is 1, and in terms of Vickers hardness, a class range of bins in the histogram is from more than (n−1)×20+450 to n×20+450 or less, where n is an integer from 1 to 10, in a surface layer of the base steel sheet, the area ratio of quenched martensite is 80% or less, where the surface layer of the base steel sheet is a region from the surface of the base steel sheet to a depth of 10 μm, and surface layer softening thickness of the base steel sheet is 10 μm or more and 100 μm or less, wherein an amount of low temperature range diffusible hydrogen in the base steel sheet is 0.015 mass ppm or less, where the amount of low temperature range diffusible hydrogen in the base steel sheet is the amount of hydrogen released from the base steel sheet when heated from room temperature to 50° C.

2. The hot-dip galvanized steel sheet according to claim 1, wherein the chemical composition of the base steel sheet further contains, in mass %, at least one selected from the group consisting of O: 0.0100% or less, Ti: 0.200% or less, Nb: 0.200% or less, V: 0.200% or less, Ta: 0.10% or less, W: 0.10% or less, B: 0.0100% or less, Cr: 1.00% or less, Mo: 1.00% or less, Ni: 1.00% or less, Co: 0.010% or less, Cu: 1.00% or less, Sn: 0.200% or less, Sb: 0.200% or less, Ca: 0.0100% or less, Mg: 0.0100% or less, REM: 0.0100% or less, Zr: 0.100% or less, Te: 0.100% or less, Hf: 0.10% or less, and Bi: 0.200% or less.

3. The hot-dip galvanized steel sheet according to claim 1, wherein the galvanized layer is a galvannealed layer.

4. A method for producing a hot-dip galvanized steel sheet, the method comprising:

applying a hot rolling process to a steel slab having the chemical composition according to claim 1 to obtain a hot-rolled steel sheet, under a set of conditions including:

coiling temperature: 350° C. or more and 600° C. or less, and holding time in a temperature range of 300° C. or more in post-coiling cooling: 5000 s or more;

pickling the hot-rolled steel sheet;

applying a first heat treatment to the hot-rolled steel sheet, under a set of conditions including:

heat treatment temperature: 450° C. or more and 650° C. or less, and holding time in a temperature range of 400° C. or more to the heat treatment temperature or less: 10 min or more;

cold rolling the hot-rolled steel sheet to obtain a cold-rolled steel sheet;

annealing the cold-rolled steel sheet, under a set of conditions including:

average heating rate in a temperature range of 250° C. or more to 700° C. or less: 10° C./s or more, oxygen concentration in a temperature range of 250° C. or more to 700° C. or less: 0.5 vol % or more and 5.0 vol % or less, annealing temperature: 820° C. or more and 950° C. or less, and dew point at annealing temperature range: −35° C. or more;

applying a hot-dip galvanizing treatment to the cold-rolled steel sheet to produce a galvanized steel sheet;

cooling the galvanized steel sheet under a set of conditions including cooling stop temperature: 150° C. or less; and applying a second heat treatment to the galvanized steel sheet under a set of conditions satisfying the following Formula (1):

$$6.5 \leq (T+273)\times\{\log(t\times 3600)+20\}/1000 \leq 13.0 \quad \text{(Formula 1)}$$

where T is the heat treatment temperature in the second heat treatment (° C.) and t is the heat holding time in the second heat treatment (h).

5. The method for producing a hot-dip galvanized steel sheet according to claim 4, wherein, after applying the hot-dip galvanizing treatment, an alloying treatment is applied to the galvanized steel sheet.

6. A member made using the hot-dip galvanized steel sheet according to claim 1.

7. The member according to claim 6, wherein the member is for an automobile frame structural part or for an automobile reinforcing part.

8. The hot-dip galvanized steel sheet according to claim 2, wherein the galvanized layer is a galvannealed layer.

9. A method for producing a hot-dip galvanized steel sheet, the method comprising:

applying a hot rolling process to a steel slab having the chemical composition according to claim 2 to obtain a hot-rolled steel sheet, under a set of conditions including:

coiling temperature: 350° C. or more and 600° C. or less, and holding time in a temperature range of 300° C. or more in post-coiling cooling: 5000 s or more;

pickling the hot-rolled steel sheet;

applying a first heat treatment to the hot-rolled steel sheet, under a set of conditions including:

heat treatment temperature: 450° C. or more and 650° C. or less, and holding time in a temperature range of 400° C. or more to the heat treatment temperature or less: 10 min or more;

cold rolling the hot-rolled steel sheet to obtain a cold-rolled steel sheet;

annealing the cold-rolled steel sheet, under a set of conditions including:

average heating rate in a temperature range of 250° C. or more to 700° C. or less: 10° C./s or more, oxygen concentration in a temperature range of 250° C. or more to 700° C. or less: 0.5 vol % or more and 5.0 vol % or less, annealing temperature: 820° C. or more and 950° C. or less, and dew point at annealing temperature range: −35° C. or more;

applying a hot-dip galvanizing treatment to the cold-rolled steel sheet to produce a galvanized steel sheet;

cooling the galvanized steel sheet under a set of conditions including cooling stop temperature: 150° C. or less; and applying a second heat treatment to the galvanized steel sheet under a set of conditions satisfying the following Formula (1):

$$6.5 \leq (T + 273) \times \{\log(t \times 3600) + 20\}/1000 \leq 13.0 \quad \text{(Formula 1)}$$

where Tis the heat treatment temperature in the second heat treatment (° C.) and t is the heat holding time in the second heat treatment (h).

10. The method for producing a hot-dip galvanized steel sheet according to claim 9, wherein, after applying the hot-dip galvanizing treatment, an alloying treatment is applied to the galvanized steel sheet.

11. A member made using the hot-dip galvanized steel sheet according to claim 2.

12. A member made using the hot-dip galvanized steel sheet according to claim 3.

13. A member made using the hot-dip galvanized steel sheet according to claim 8.

14. The member according to claim 11, wherein the member is for an automobile frame structural part or for an automobile reinforcing part.

15. The member according to claim 12, wherein the member is for an automobile frame structural part or for an automobile reinforcing part.

16. The member according to claim 13, wherein the member is for an automobile frame structural part or for an automobile reinforcing part.

* * * * *